US009745731B2

(12) United States Patent
Kitaura et al.

(10) Patent No.: US 9,745,731 B2
(45) **Date of Patent: *Aug. 29, 2017**

(54) FLUSH TOILET APPARATUS

(71) Applicant: TOTO LTD., Fukuoka (JP)

(72) Inventors: Hidekazu Kitaura, Kitakyushu (JP); Ryoko Ishimaru, Kitakyushu (JP); Tomohiro Iwabata, Kitakyushu (JP)

(73) Assignee: TOTO LTD., Fukuoka (JP)

( * ) Notice: Subject to any disclaimer, the term of this patent is extended or adjusted under 35 U.S.C. 154(b) by 122 days.

This patent is subject to a terminal disclaimer.

(21) Appl. No.: 14/450,502

(22) Filed: Aug. 4, 2014

(65) Prior Publication Data

US 2015/0040304 A1 Feb. 12, 2015

(30) Foreign Application Priority Data

| | | |
|---|---|---|
| Aug. 12, 2013 | (JP) | 2013-167803 |
| Sep. 26, 2013 | (JP) | 2013-200586 |
| Jun. 16, 2014 | (JP) | 2014-123463 |
| Jun. 16, 2014 | (JP) | 2014-123658 |

(51) Int. Cl.

| | |
|---|---|
| ***E03D 11/18*** | (2006.01) |
| ***E03D 1/00*** | (2006.01) |
| ***E03D 1/06*** | (2006.01) |
| ***E03D 5/01*** | (2006.01) |
| ***E03D 1/08*** | (2006.01) |

(52) U.S. Cl.

CPC ..... *E03D 5/01* (2013.01); *E03D 1/085* (2013.01)

(58) Field of Classification Search

CPC ..... E03D 1/263; E03D 5/01
USPC ... 4/432, 428, 353, 363, 368, 369, 370, 324, 4/415

See application file for complete search history.

(56) References Cited

U.S. PATENT DOCUMENTS

| | | | | |
|---|---|---|---|---|
| 2,073,835 | A * | 3/1937 | Finley | E03D 1/087 137/145 |
| 2,120,856 | A * | 6/1938 | Collison | E03D 1/082 4/369 |
| 2010/0299824 | A1 | 12/2010 | Vargas et al. | |
| 2013/0111657 | A1 | 5/2013 | Song | |

FOREIGN PATENT DOCUMENTS

| | | | |
|---|---|---|---|
| JP | 2004-156382 | A | 6/2004 |
| WO | 2005/106141 | A1 | 11/2005 |

OTHER PUBLICATIONS

JP 2004-156382A English machine translation dated May 4, 2016.*

* cited by examiner

*Primary Examiner* — Christine Skubinna
(74) *Attorney, Agent, or Firm* — Studebaker & Brackett PC

(57) ABSTRACT

A flush toilet apparatus that can reduce the total amount of wash water supplied to a bowl portion, even though a jet-pump water supply mechanism is mounted on a wash-down toilet body. A jet pump unit induces a jet pump action for making a flow rate of water flowing inside of a throat pipe higher than a flow rate of water injected from a nozzle to supply water at the increased flow rate to water ejection portions, and the flush toilet apparatus switches a channel state of the jet pump unit to sequentially execute a water flow forming step, in which water at a first flow rate is supplied to the water ejection portions, and a water flow maintaining step, following the water flow forming step and in which water at a second flow rate lower than the first flow rate is supplied to the water ejection portions.

13 Claims, 24 Drawing Sheets

(A)

(B)

(A)

(B)

FLUSH TOILET APPARATUS

BACKGROUND OF THE INVENTION

Field of the Invention

The present invention relates to a flush toilet apparatus that washes a toilet body by wash water.

Description of the Related Art

Conventionally, a flush toilet apparatus using a tank-type or direct-pressure water supply mechanism is widely used as a mechanism for supplying wash water to a flush toilet apparatus body.

The tank-type water supply mechanism is configured to store water in a tank in advance and supply the water to a toilet body as wash water. In the tank-type water supply mechanism, all of the water supplied as wash water needs to be stored in the tank, and there is a problem that the tank mounted on the flush toilet apparatus is large.

After the completion of washing of the toilet body, the tank needs to be at a full water level for the next washing. However, it takes time to pour water into the large tank to reach the full water level. Therefore, continuous washing (at short intervals) is difficult, and there is a problem that the tank-type water supply mechanism is not suitable for a situation in which the flush toilet apparatus is frequently used.

The direct-pressure water supply mechanism is configured to use water pressure in a water supply pipe (water pipe) arranged in a building to supply wash water to the toilet body from the water supply pipe. In the direct-pressure water supply mechanism, the flow rate of the wash water depends on the water pressure in the water supply pipe. Therefore, there is a problem that the washing performance is reduced when the flush toilet apparatus is installed in an environment with low water pressure (for example, upper floors).

A jet-pump water supply mechanism is newly proposed as a water supply mechanism that can simultaneously solve both of the problem in the tank-type water supply mechanism and the problem in the direct-pressure water supply mechanism (see Japanese Patent Laid-Open No. 2004-156382).

The jet-pump water supply mechanism described in Japanese Patent Laid-Open No. 2004-156382 includes a tank storing water, and a jet pump unit is submerged and arranged inside of the tank. The jet pump unit includes a throat pipe. One end of the throat pipe is connected to a channel toward a bowl portion of the toilet body, and an opening is formed on the other end. When water is injected from an injection nozzle toward the inside of the throat pipe through the opening, a jet pump action is induced, and a large amount of water flows toward the bowl portion inside of the throat pipe. Not only the water injected from the injection nozzle, but also the water stored in the tank is drawn in and flows inside of the throat pipe. Therefore, a large amount of wash water is supplied to the toilet body.

Not all of the water supplied as wash water to the toilet body needs to be stored in the tank in the jet-pump water supply mechanism. Therefore, the tank can be smaller than in the tank-type water supply mechanism, and there is an advantage that the time necessary for the tank to reach the full water level can be reduced. A large amount and a constant flow rate of wash water can be supplied to the toilet body even when the flush toilet apparatus is installed in an environment with relatively low water pressure in the water supply pipe.

In one type of toilet body, the waste is pushed out to a drainage channel by wash water supplied to a bowl portion (hereinafter, also called "wash-down toilet body"). The wash-down toilet body, which is also called a "wash-out toilet body", forms a large water flow from the bowl portion toward the drain pipe to provide momentum to the waste to thereby move the waste to the drain pipe to discharge the waste. Therefore, in the wash-down toilet body, the water flow needs to be maintained until at least the waste gets over a trap portion and moves to the drain pipe. More specifically, the wash-down toilet body needs to continuously receive the supply of wash water from the water supply mechanism.

As already described, the jet-pump water supply mechanism can supply a large amount of water to the bowl portion of the toilet body at a constant flow rate without being influenced by the change in the water pressure in the water pipe or the change in the water level (potential energy) in the tank. Therefore, when the jet-pump water supply mechanism is mounted on the wash-down toilet body, wash water at a constant flow rate is always supplied to the bowl portion until the waste gets over the trap portion and moves to the drain pipe.

However, the present inventors have conducted intensive studies and found that the flow rate of the minimum wash water necessary to discharge waste in the wash-down toilet body is not always constant in the process of washing, and the minimum wash water changes with time. More specifically, the supply of wash water needs to be continued until the waste gets over the trap portion and moves to the drain pipe in the wash-down toilet body. It has become clear that part of the wash water may be wasted if the jet-pump water supply mechanism always supplies water at a constant flow rate.

In this way, the total amount of wash water supplied to the bowl portion can be reduced to further save water in the flush toilet apparatus including the jet-pump water supply mechanism mounted on the wash-down toilet body.

The present invention has been made in view of the problems, and an object of the present invention is to provide a flush toilet apparatus that can reduce the total amount of wash water supplied to a bowl portion, even though a jet-pump water supply mechanism is mounted on a wash-down toilet body.

SUMMARY OF THE INVENTION

To solve the problems, the present invention provides a flush toilet apparatus that washes a toilet body by wash water, the flush toilet apparatus including: a wash-down toilet body including: a bowl portion that receives waste; and a water ejection portion that ejects water for discharging the waste to supply the water to the bowl portion, wherein the water supplied to the bowl portion pushes out the waste to a drainage channel; a tank storing water inside; and a jet pump unit arranged in a state that at least part of the jet pump unit is submerged inside of the tank, wherein the jet pump unit includes: a throat pipe that is a pipe provided with a suction port near one end and that is arranged so that water entering inside from the suction port is supplied to the water ejection portion, and the water is ejected from the water ejection portion as wash water; and a nozzle that injects high-speed water from the suction port toward the inside of the throat pipe, the jet pump unit is configured to induce a jet pump action for making a flow rate of the water flowing inside of the throat pipe higher than a flow rate of the water injected from the nozzle and to supply the water at the increased flow rate to the water ejection portion, and the flush toilet apparatus further includes channel state switching portion for switching a channel state of the jet pump unit to sequentially execute a water flow forming step, in which the jet pump unit supplies water at a first flow rate to the water ejection portion, and a water flow maintaining step, which is a step following the water flow forming step and in which the jet pump unit supplies water at a second flow rate lower than the first flow rate to the water ejection portion.

The flush toilet apparatus according to the present invention includes the tank storing water inside and the jet pump unit arranged inside of the tank that are mechanisms for supplying wash water to the bowl portion of the toilet body. The toilet body is a wash-down toilet body that pushes out the waste to the drainage channel by the wash water supplied to the bowl portion.

The jet pump unit is arranged in a state that at least part of the jet pump unit is submerged inside of the tank, and the jet pump unit includes the throat pipe and the nozzle. The throat pipe is a pipe provided with the suction port near one end and is arranged so that the water entering inside from the suction port is supplied to the water ejection portion of the toilet body (from the other end). The water is ejected from the water ejection portion as wash water.

The nozzle injects the high-speed water from the suction port toward the inside of the throat pipe to induce the jet pump action. Due to the jet pump action, not only the water injected from the nozzle, but also the water stored in the tank is drawn in and enters the suction port. In other words, as a result of the jet pump action, the flow rate of the water flowing inside of the throat pipe becomes higher than the flow rate of the water injected from the nozzle (it can also be stated that the flow rate is amplified). The water at the increased flow rate is supplied to the water ejection portion of the toilet body, and the water is ejected from the water ejection portion.

In the flush toilet apparatus according to the present invention, the flow rate of the water supplied to the water ejection portion by the jet pump unit is not constant until the end of washing, and the flow rate is changed in the middle of washing. Specifically, a water flow forming step of supplying water at the first flow rate to the water ejection portion is executed, and then a water flow maintaining step of supplying water at the second flow rate lower than the first flow rate to the water ejection portion is executed. The channel switching means switches the channel state of the jet pump unit to realize the change in the flow rate.

The water flow forming step is a step of supplying water to the water ejection portion to thereby form a water flow in the bowl portion of the toilet body. In the water flow forming step, momentum needs to be provided to the water stored in the bowl portion in the resting state to form a water flow, and a large amount (first flow rate) of water is supplied from the jet pump unit to the water ejection portion. As a result of the supply of a large amount of water, the waste attached to the bowl portion is removed in a short time.

The water flow maintaining step following the water flow forming step is a step of continuously supplying water to the water ejection portion to thereby maintain the water flow in the bowl portion formed in the water flow forming step. The water flow is already formed in the bowl portion, and inertia force is acting in the water. Therefore, the supply of water necessary to maintain the water flow in the bowl portion is smaller than the supply of water (first flow rate) necessary to form the water flow.

Thus, in the water flow maintaining step, the channel state switching portion changes the channel state of the jet pump unit to reduce the flow rate of the water supplied to the water ejection portion (changes the first flow rate to the second flow rate). As a result, the total amount of water supplied from the jet pump unit to the water ejection portion can be reduced, and the water saving capacity can be improved, while forming and maintaining the water flow necessary to discharge the waste in the bowl portion.

In this way, the total amount of wash water supplied to the bowl portion can be reduced while ensuring the discharge performance of the waste throughout the entire period in which the jet pump unit supplies water to the water ejection portion in the flush toilet apparatus according to the present invention. As a result, the water saving capacity can be improved without sacrificing the washing performance.

In the flush toilet apparatus according to the present invention, it is also preferable that the higher the flow rate of the water supplied to the water ejection portion in the water flow forming step, the earlier the timing of transition from the water flow forming step to the water flow maintaining step.

The flow rate of the water supplied to the water ejection portion by the jet pump unit may not be strictly as in the design value due to, for example, the machine difference in the constant flow valve arranged on the upstream side of the nozzle, and the flow rate may vary between products. As a result, the timing of transition from the water flow forming step to the water flow maintaining step may become inappropriate. A sufficient water flow may not be formed in the bowl portion, or the washing performance of the bowl portion may not be ensured.

For example, when the flow rate of the water supplied to the water ejection portion in the water flow forming step is higher than the design value, water at the first flow rate is continuously supplied to the bowl portion even after the formation of a sufficient water flow in the bowl portion.

On the other hand, when the flow rate of the water supplied to the water ejection portion in the water flow forming step is lower than the design value, the water flow forming step is switched to the water flow maintaining step before an amount of water necessary to form a water flow is supplied to the bowl portion, and the water flow necessary to convey the waste is not formed.

In this preferred aspect, the higher the flow rate of the water supplied to the water ejection portion in the water flow forming step, the earlier the timing of transition from the water flow forming step to the water flow maintaining step. More specifically, the timing of transition from the water flow forming step to the water flow maintaining step (length of the period of the water flow forming step) is not fixed, and the timing is changed according to the flow rate of the water supplied to the water ejection portion in the water flow forming step.

In this preferred aspect, the timing of transition from the water flow forming step to the water flow maintaining step becomes earlier (period of the water flow forming step becomes shorter) when the flow rate of the water supplied to the water ejection portion in the water flow forming step becomes higher than the design value. This prevents continuous and wasteful supply of a large amount of wash water when a sufficient water flow is formed in the bowl portion.

On the other hand, the timing of transition from the water flow forming step to the water flow maintaining step becomes later (period of the water flow forming step becomes longer), and the time for supplying a large amount of wash water becomes longer when the flow rate of the water supplied to the water ejection portion in the water flow forming step becomes lower than the design value. As a result, a sufficient water flow is surely formed in the bowl portion.

In this way, the timing of transition from the water flow forming step to the water flow maintaining step is adjusted to be appropriate according to the change (variation) in the flow rate of the water supplied to the water ejection portion in the water flow forming step in this preferred aspect.

In the flush toilet apparatus according to the present invention, it is also preferable that the water flow forming step is switched to the water flow maintaining step when the water level in the tank decreases to a predetermined water level set at a position lower than a full water level and higher than the suction port.

In this preferred aspect, the water flow forming step is switched to the water flow maintaining step when the water level in the tank decreases to the predetermined water level set at the position lower than the full water level and higher than the suction port. The water level in the tank decreases to the predetermined water level at an early point when the flow rate of the water supplied to the water ejection portion in the water flow forming step becomes higher than the design value. Therefore, the timing of transition from the water flow forming step to the water flow maintaining step becomes earlier (period of the water flow forming step becomes shorter). The time before the water level in the tank reaches the predetermined water level after reduction in the water level becomes longer when the flow rate of the water supplied to the water ejection portion in the water flow forming step becomes lower than the design value. Therefore, the timing of transition from the water flow forming step to the water flow maintaining step becomes later (period of the water flow forming step becomes longer).

In this way, the timing of transition from the water flow forming step to the water flow maintaining step can be appropriately adjusted without directly measuring the flow rate of the water supplied to the water ejection portion in the water flow forming step. Thus, an apparatus such as a flowmeter is not necessary, and the timing of transition to the water flow maintaining step can be appropriately adjusted with a simple configuration.

In the flush toilet apparatus according to the present invention, it is also preferable that the channel state switching portion switches the channel state on a downstream side of the nozzle in the jet pump unit.

Channel state switching portion can, for example, change the channel state on the upstream side of the injection port of the nozzle in the jet pump unit to thereby switch the water flow forming step to the water flow maintaining step. For example, the flow rate of the water injected from the nozzle can be reduced to suppress the jet pump action to thereby switch the water flow forming step to the water flow maintaining step.

However, the flow rate of the water flowing inside of the throat pipe is derived by increasing (amplifying) the flow rate of the water injected from the nozzle by the jet pump action, and the flow rate of the water flowing inside of the throat pipe is significantly reduced just by slightly reducing the flow rate of the water injected from the nozzle. Therefore, it is not easy to change the channel state on the upstream side of the injection port of the nozzle to change the first flow rate to an appropriate second flow rate. According to such a mode, the flow rate of the water supplied to the water ejection portion in the water flow maintaining step may be too low, and the water flow may not be maintained.

Therefore, the channel state switching portion in the flush toilet apparatus according to the present invention switches the channel state on the downstream side of the nozzle in the jet pump unit. According to the configuration, it is easy to appropriately adjust the flow rate of the water flowing inside of the throat pipe. This prevents the flow rate (second flow rate) of the water supplied to the water ejection portion in the water flow maintaining step from becoming too low.

In the flush toilet apparatus according to the present invention, it is also preferable that the channel state switching portion switches the channel state on the downstream side of the suction port in the jet pump unit.

The part between the injection port of the nozzle and the suction port of the throat pipe in the jet pump unit is a part where the flow rate is amplified by the jet pump action. The flow rate of water at a part on the upstream side (near the injection port) of the part is substantially equal to the flow rate of the water injected from the injection port. On the other hand, the flow rate of water is amplified at a part on the downstream side (near the suction port) and is higher than the flow rate of the water injected from the injection port.

Therefore, when the channel state switching portion is configured to switch the channel state at the part between the injection port of the nozzle and the suction port of the throat pipe, the change (decrease) in the flow rate at the part is amplified on the downstream side by the jet pump action. The flow rate of the water supplied to the water ejection portion in the water flow maintaining step may be too low.

In this preferred aspect, the channel state switching portion switches the channel state on the downstream side of the suction port in the jet pump unit. Since the water flowing through the part on the downstream side of the suction port is water in which the amplification of the flow rate by the jet pump action is substantially completed, it is relatively easy for the channel state switching portion to switch the channel state of the part to appropriately adjust the flow rate of the water flowing inside of the throat pipe. This can surely prevent the flow rate (second flow rate) of the water supplied to the water ejection portion in the water flow maintaining step from becoming too low.

In the flush toilet apparatus according to the present invention, it is also preferable that the throat pipe includes: a rising portion extending upward from the suction port; a curved portion arranged on the downstream side of the rising portion; and a falling portion arranged on the downstream side of the curved portion and extending downward from the curved portion, wherein the entire throat pipe is formed in an inverted U-shape, and the channel state switching portion switches the channel state on an upstream side of the falling portion in the jet pump unit.

In this preferred aspect, the entire throat pipe is formed in the inverted U-shape. Specifically, the rising portion extending upward from the suction port, the curved portion arranged on the downstream side of the rising portion, and the falling portion arranged on the downstream side of the curved portion and extending downward from the curved portion are included. The entire throat pipe is formed in the inverted U-shape, and this prevents the water in the tank from flowing out toward the toilet body when the toilet body is not washed, even if the tank is arranged on the upper side of the toilet body.

When the throat pipe has such a shape, it is difficult for the channel state switching portion to change the channel state of the falling portion to thereby suppress the jet pump action in the water flow maintaining step. This can be because the amplification of the flow rate by the jet pump action is substantially completed inside of the falling portion, and the influence of the channel resistance is low since the flow velocity of the water flowing inside of the falling portion is relatively slow (high-speed water injected from the nozzle and the water in the tank conveyed due to the high-speed water are sufficiently mixed, and the flow velocity is slower than the flow velocity of the water injected from the nozzle as a result of the equalization of the flow velocity in the channel cross section). When the channel state switching portion is configured to change the channel resistance of the falling portion, the channel state switching portion needs to be a large-scale mechanism. This increases the cost and enlarges the tank.

In this preferred aspect, the channel state switching portion switches the channel state on the upstream side of the falling portion of the throat pipe in the jet pump unit. According to the configuration, it is easier for the channel state switching portion to switch the channel state of the throat pipe to appropriately adjust the flow rate of the water flowing inside of the throat pipe.

In the flush toilet apparatus according to the present invention, it is also preferable that the channel state switching portion includes an air introduction portion that introduces air to a water flow generated by the jet pump action, and the channel state switching portion switches the channel state of the jet pump unit so that an air introduction flow rate from the air introduction portion in the water flow maintaining step is greater than an air introduction flow rate from the air introduction portion in the water flow forming step.

In this preferred aspect, the channel state switching portion includes the air introduction portion that introduces air to the water flow generated by the jet pump action and switches the flow rate state of the jet pump so that the air introduction flow rate from the air introduction portion in the water flow maintaining step is greater than the air introduction flow rate from the air introduction portion in the water flow forming step. The channel state of the jet pump unit is changed by the introduced air, and the jet pump action is suppressed. As a result, the flow rate of the water supplied to the water ejection portion is changed from the first flow rate to the second flow rate (water flow forming step is switched to water flow maintaining step). The flow rate of the water supplied to the water ejection portion can be appropriately adjusted by a simple configuration of introducing air.

In the flush toilet apparatus according to the present invention, it is also preferable that the introduction port is formed at a position submerged in the tank in a period that the water flow forming step is executed and not submerged in the tank in a period that the water flow maintaining step is executed.

In this preferred aspect, the introduction port is formed at the position submerged in the tank in the period that the water flow forming step is executed. Therefore, the water (not air) in the tank is sucked from the air introduction port in the period, and the water joins the water flow generated by the jet pump action. As a result, a large amount of water is supplied to the water ejection portion, and a water flow necessary to discharge the waste is surely formed in the bowl portion.

The introduction port is formed at the position not submerged in the tank in the period that the water flow maintaining step is executed. Therefore, the introduction of air and mixing of the air with the water flow are started at an appropriate timing of transition to the water flow maintaining step after the end of the water flow forming step. As a result, the flow rate of the water supplied to the bowl portion can be reduced (jet pump action can be suppressed) at an appropriate timing, without a movable member that moves every time washing is performed.

In the flush toilet apparatus according to the present invention, it is also preferable that the throat pipe includes: a rising portion extending upward from the suction port; a curved portion arranged on the downstream side of the rising portion; and a falling portion arranged on the downstream side of the curved portion and extending downward from the curved portion, wherein the entire throat pipe is formed in an inverted U-shape, and the air introduced from the introduction port is mixed with the water flow generated by the jet pump action at a position on the upstream side of the falling portion.

In this preferred aspect, the entire throat pipe is formed in the inverted U-shape. Specifically, the rising portion extending upward from the suction port, the curved portion arranged on the downstream side of the rising portion, and the falling portion arranged on the downstream side of the curved portion and extending downward from the curved portion are included. The entire throat pipe is formed in the inverted U-shape, and this can prevent the water in the tank from flowing out toward the toilet body when the toilet body is not washed, even if the tank is arranged on the upper side of the toilet body.

When the throat pipe has such a shape, the water in the tank cannot be at the full water level if the air is mixed inside of the falling portion of the throat pipe. This is because the introduction port of the air introduction portion is submerged when the water in the tank is at the full water level, and the water entering the falling portion from the introduction port is directly supplied to the ejection portion of the toilet body.

In this preferred aspect, the position where the air is mixed with the water flow generated by the jet pump action is on the upstream side of the falling portion. The configuration can prevent the water in the tank from entering the throat pipe from the introduction port of the air introduction portion and directly flowing out toward the toilet body when the toilet body is not washed.

In the flush toilet apparatus according to the present invention, it is also preferable that the air introduced from the introduction port is mixed with the water flow generated by the jet pump action at a position on the downstream side of the suction port.

When the air from the air introduction portion is mixed at the position between the injection port of the nozzle and the suction port of the throat pipe, the tip of the air introduction portion (for example, pipe) inhibits the flow of the water entering inside of the throat pipe from the suction port, and the jet pump action may be inhibited. As a result, the flow rate of the water supplied to the water ejection portion may decrease (particularly in the water flow forming step).

In this preferred aspect, the air introduced from the introduction port of the air introduction portion is mixed with the water flow generated by the jet pump action at the position on the downstream side of the suction port. The configuration prevents the air introduction portion from inhibiting the flow of the water entering inside of the throat pipe from the suction port. As a result, the jet pump action in the water flow forming step is not inhibited.

In the flush toilet apparatus according to the present invention, it is also preferable that the throat pipe includes: a rising portion extending upward from the suction port; a curved portion arranged on the downstream side of the rising portion; and a falling portion arranged on the downstream side of the curved portion and extending downward from the curved portion, wherein the entire throat pipe is formed in an inverted U-shape, and a siphon action is generated in addition to the jet pump action, water is supplied to the water ejection portion based on the jet pump action and the siphon action in the water flow forming step, and the siphon action is stopped after the transition to the water flow maintaining step.

In this preferred aspect, the jet pump unit includes the throat pipe in the inverted U-shape. Therefore, the siphon action can be generated in addition to the jet pump action.

In the water flow forming step, the water is supplied to the water ejection portion based on the jet pump action and the siphon action. Therefore, the flow rate (first flow rate) of the water supplied to the water ejection portion in the water flow forming step can be further increased, and the water flow necessary to discharge the waste can be surely formed in the bowl portion.

The siphon action that has been generated stops at a point after the transition to the water flow maintaining step. Therefore, the flow rate of the water (large amount) supplied to the water ejection portion can be easily reduced in the water flow maintaining step.

In the flush toilet apparatus according to the present invention, it is preferable that the timing of transition from the water flow forming step to the water flow maintaining step and the timing of stopping the siphon action are different.

In this preferred aspect, the timing of transition from the water flow forming step to the water flow maintaining step and the timing of stopping the siphon action are different. Therefore, the siphon action is not stopped at the same time as the suppression of the jet pump action after the transition to the water flow maintaining step. The siphon action is stopped after a lapse of time from the suppression of the jet pump action.

According to the configuration, the flow rate (second flow rate) of the water supplied to the water ejection portion in the water flow maintaining step is not constant, and decreases in stages with time. Therefore, the timing of stopping the siphon action is adjusted, and the supply of water in the water flow maintaining step (change in the second flow rate) can be further appropriate.

In the flush toilet apparatus according to the present invention, it is also preferable that the channel state switching portion includes an air introduction portion provided with an introduction port for introducing air, uses negative pressure generated by a water flow to introduce the air from the introduction port, switches the channel state of the jet pump unit by mixing the air with the water flow generated by the jet pump action, and stops the siphon action by the air mixed with the water flow from the air introduction portion.

In this preferred aspect, the channel state switching portion includes the air introduction portion provided with the introduction port for introducing air and mixes the air with the water flow generated by the jet pump action to switch the channel state of the jet pump unit to suppress the jet pump action. The negative pressure generated by the water flow is used to introduce the air from the introduction port.

The siphon action after the transition to the water flow maintaining step is stopped by the air mixed with the water flow from the air introduction portion. In this way, the configuration for suppressing the jet pump action and the configuration for stopping the siphon action are shared (air introduction means), and the structure inside of the tank can be simplified.

In the flush toilet apparatus according to the present invention, it is also preferable that the channel state switching portion changes a position of the suction port relative to the nozzle between the water flow forming step and the water flow maintaining step.

In this preferred aspect, the position of the suction port relative to the nozzle is changed between the water flow forming step and the water flow maintaining step. As a result of changing the position of the suction port relative to the nozzle, for example, the channel state of the jet pump unit is changed so that only part of the water injected from the nozzle enters the suction port, and the flow rate of the water supplied to the water ejection portion is changed from the first flow rate to the second flow rate (transition from the water flow forming step to the water flow maintaining step). The water flow forming step can be switched to the water flow maintaining step with a simple configuration of changing the position of the suction port relative to the nozzle.

In the flush toilet apparatus according to the present invention, it is also preferable that the channel state switching portion switches the channel state of the jet pump unit so that a channel resistance of the jet pump unit in the water flow maintaining step is greater than a channel resistance of the jet pump unit in the water flow forming step.

In this preferred aspect, the channel state switching portion switches the channel state of the jet pump so that the channel resistance of the jet pump unit in the water flow maintaining step is greater than the channel resistance of the jet pump unit in the water flow forming step. The channel state of the jet pump can be switched to surely change the flow rate of the water supplied to the water ejection portion, from the first flow rate to the second flow rate.

In the flush toilet apparatus according to the present invention, it is also preferable that the channel state switching portion switches the channel state of the jet pump unit so that part of the water flowing through the channel of the jet pump unit flows out into the tank and switches the channel state of the jet pump unit so that a flow rate of the water that flows out into the tank in the water flow maintaining step is at least higher than that in the water flow forming step.

In this preferred aspect, the channel state switching portion switches the channel state of the jet pump unit so that the flow rate of the water that flows out into the tank in the water flow maintaining step is higher than that in the water flow forming step. The channel state of the jet pump unit can be switched to surely change the flow rate of the water supplied to the water ejection portion, from the first flow rate to the second flow rate.

The present invention can provide a flush toilet apparatus that can reduce the total amount of wash water supplied to a bowl portion, even though a jet-pump water supply mechanism is mounted on a wash-down toilet body.

DETAILED DESCRIPTION OF THE PREFERRED EMBODIMENTS

Figure 1:
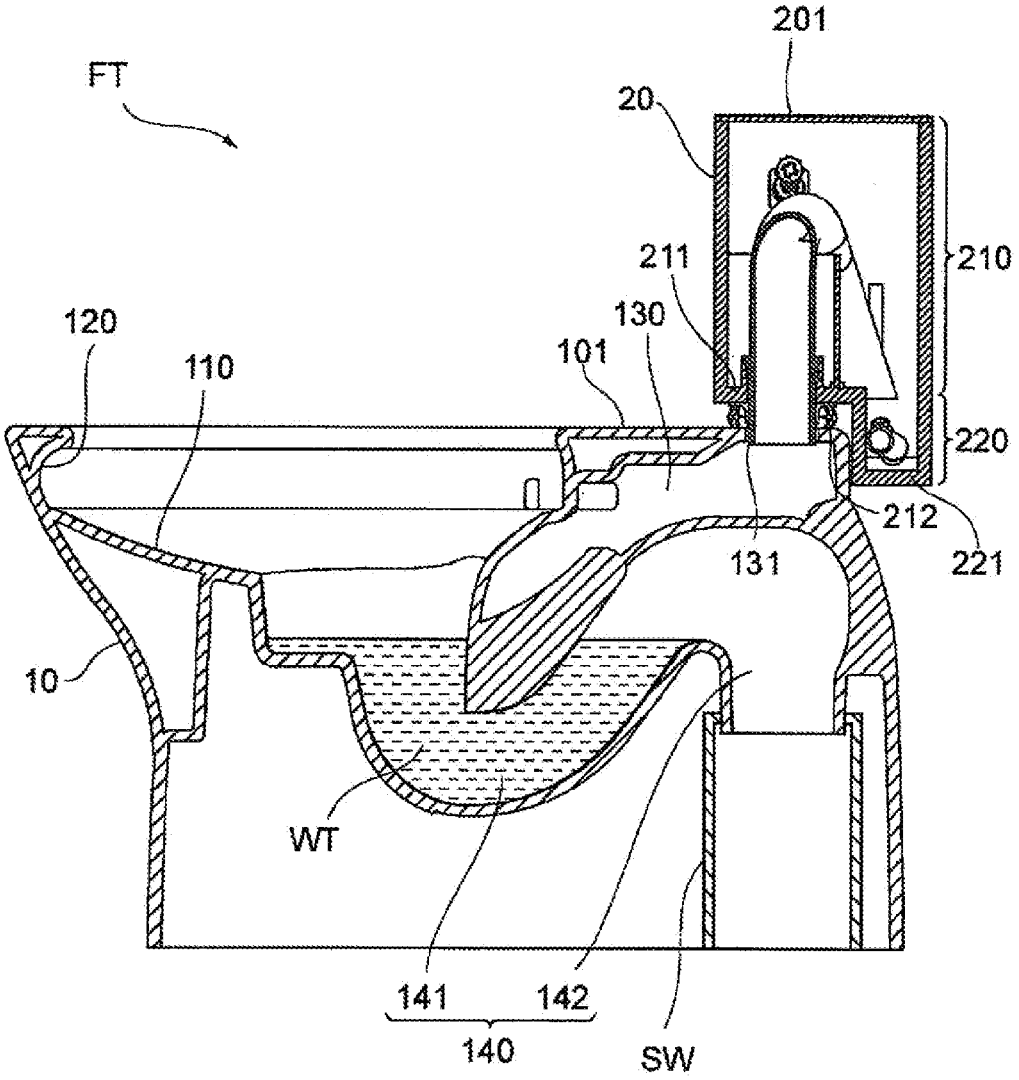
FIG. 1 is a cross-sectional view showing a flush toilet apparatus according to a first embodiment of the present invention.

Hereinafter, embodiments of the present invention will be described with reference to the attached drawings. To facilitate understanding of the description, the same constituent elements are designated with the same reference numerals as much as possible in the drawings, and the description will not be repeated.

Figure 2:
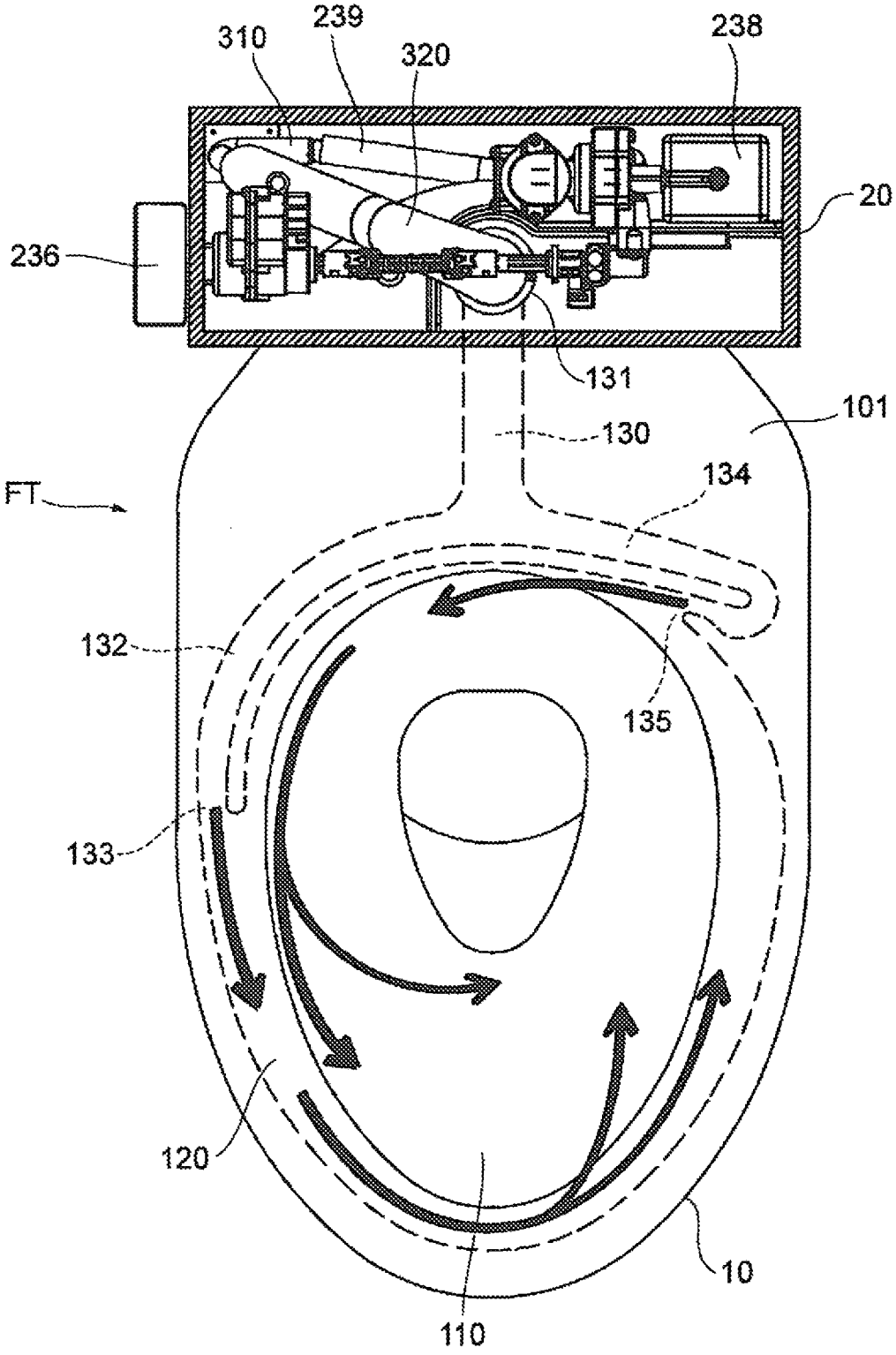
FIG. 2 is a top view of the flush toilet apparatus shown in FIG. 1.

A flush toilet apparatus according to a first embodiment of the present invention will be described with reference to FIGS. 1 and 2. FIG. 1 is a cross-sectional view of a flush toilet apparatus FT, showing a cross section when the flush toilet apparatus FT is cut at a surface perpendicular to a horizontal direction. FIG. 2 is a top view of the flush toilet apparatus FT. FIG. 2 depicts a state that an upper lid 201 of a tank 20 is removed in order to show an internal structure of the tank 20 described later.

As shown in FIGS. 1 and 2, the flush toilet apparatus FT includes: a toilet body 10; and the tank 20 installed on an upper surface 101 of the toilet body 10 on a backward side (right side in FIG. 1 and upper side in FIG. 2) of the toilet body 10. The flush toilet apparatus FT is an apparatus, in which the toilet body 10 receives waste, and water (wash water) supplied from the tank 20 discharges the waste to a drain pipe SW.

In the following description, a right side (left side in FIG. 2) as seen from a user seated on the toilet body 10 will be called "right side", and a left side as seen from the user seated on the toilet body 10 will be called "left side" (right side in FIG. 2), unless otherwise stated. A forward side (left side in FIG. 1 and lower side in FIG. 2) as seen from the user seated on the toilet body 10 will be called "front side" or "forward side", and a backward side (right side in FIG. 1 and upper side in FIG. 2) as seen from the user seated on the toilet body 10 will be called "back side" or "backward side".

The toilet body 10 includes a bowl portion 110, a rim portion 120, a water conduit 130, and a drain trap pipeline 140. The bowl portion 110 is a part that temporarily receives the waste falling from above. The rim portion 120 is formed at an upper edge portion of the bowl portion 110, and the rim portion 120 has a shape such that part of the inner surface of the bowl portion 110 is retracted toward the circumference as shown in FIG. 1. As described later, the rim portion 120 is a channel in which water supplied toward the bowl portion 110 swirls and flows. The rim portion 120 is formed as a substantially round (in the view from the top) channel that goes around along the upper edge of the bowl portion 110.

The water conduit 130 is a channel formed inside of the toilet body 10 to guide water supplied from the tank 20 to the bowl portion 110. One end of the water conduit 130 opens into the upper surface 101 of the toilet body 10 to form an inlet 131 of the water supplied from the tank 20. The position of the formation of the inlet 131 is at a part on the backward side of the upper surface 101 of the toilet body 10 and is at a center part in the horizontal direction.

The water conduit 130 is branched into two channels (first water conduit 132 and second water conduit 134) in the downstream. An end portion on the downstream side of the first water conduit 132 as one of the channels opens into a part on the right side of the rim portion 120, and the opening is an outlet (water ejection portion 133) of water. When water is supplied from the tank 20 to the inlet 131, part of the water passes through the first water conduit 132, and the water is ejected from the water ejection portion 133 and supplied to the rim portion 120.

An end portion on the downstream side of the second water conduit 134 as the other channel opens into a part on the left side of the rim portion 120, near the back, and the opening is an outlet (water ejection portion 135) of water. When water is supplied from the tank 20 to the inlet 131, part of the water passes through the second water conduit 134, and the water is ejected from the water ejection portion 135 and supplied to the rim portion 120.

The direction of the ejection of water from the water ejection portion 133 is a direction along the circumference of the rim portion 120 formed as a substantially round channel and is a counterclockwise direction in the view from the top. The direction of the ejection of water from the water ejection portion 135 is also the direction along the circumference of the rim portion 120 formed as a substantially round channel and is the counterclockwise direction in the view from the top. As indicated by arrows in FIG. 2, the water ejected from the water ejection portion 133 and the water ejection portion 135 to the rim portion 120 flows down from the entire rim portion 120 toward the bowl portion 110, while swirling and flowing counterclockwise along the rim portion 120.

The drain trap pipeline 140 is a channel connecting a lower end of the bowl portion 110 and the drain pipe SW. The drain trap pipeline 140 includes: a rising channel 141 forming an uphill grade in a direction from the lower end of the bowl portion 110 toward the downstream; and a falling channel 142 forming a downhill grade in a direction from an upper end of the rising channel 141 toward the downstream. According to the configuration, water can be stored in a part from a lower part of the bowl portion 110 to a lower part of the rising channel 141, and the stored water forms sealing water WT. The drain pipe SW is connected to a lower end of the falling channel 142. The drain pipe SW is a pipe arranged inside of a building, and an end portion on the downstream side of the drain pipe SW is connected to a sewer pipe not shown.

When water is supplied from the tank 20 toward the bowl portion 110, the water flows down from the entire rim portion 120 toward the bowl portion 110, while swirling and flowing through the rim portion 120, as described above. Water is added from above to the bowl portion 110. The water passes through the rising channel 141 and the falling channel 142 from a lower end portion of the bowl portion 110, and the water is discharged. As a result, there is a downward flow of water (sealing water WT) stored in the bowl portion 110.

The waste temporarily received by the bowl portion 110 is pushed downward by the water supplied from the rim portion 120 above, and the waste moves toward the lower end of the bowl portion 110. Subsequently, the water flow causes the waste to pass through the rising channel 141, and the waste reaches the falling channel 142. The waste falls toward the drain pipe SW along with the water.

The tank 20 is a container storing water inside, and the tank 20 supplies the water to the inlet 131 of the water conduit 130. The tank 20 includes: a first tank portion 210; and a second tank portion 220 formed to extend part of a bottom wall 211 of the first tank portion 210 downward. The first tank portion 210 and the second tank portion 220 are substantially cuboid containers, and internal spaces of the portions are linked to each other. The second tank portion 220 is connected to a part on the backward side of the bottom wall 211 of the first tank portion 210.

The bottom wall 211 of the first tank portion 210 (part on the forward side of the second tank portion 220) is close to and above a part on the backward side of the upper surface 101 of the toilet body 10. Specifically, the inlet 131 is formed at the part on the backward side of the upper surface 101 of the toilet body 10, and the bottom wall 211 of the first tank portion 210 is close to and above the upper surface 101 of the toilet body 10 so as to cover the surrounding of the inlet 131 from the above. An opening 212 in substantially the same shape as the inlet 131 is formed on the bottom wall 211, and the opening 212 and the inlet 131 overlap in the view from the top. Therefore, the water stored in the tank 20 can enter inside of the water conduit 130 through the opening 212 and the inlet 131, and the water can flow toward the bowl portion 110.

As a result of the arrangement of the first tank portion 210, the second tank portion 220 is positioned behind the toilet body 10. More specifically, the second tank portion 220 is positioned on the backward side of the backward end portion of the toilet body 10. A bottom wall 221 of the second tank portion 220 is arranged at a position lower than the upper surface 101 of the toilet body 10.

As a result of the arrangement of the tank 20, a front end portion of the tank 20 is positioned on the forward side of a back end portion of the toilet body 10. A lower end portion of the tank 20 is positioned on the lower side of the upper surface 101 of the toilet body 10. As a result, the dimension in the front-back direction and the dimension in the vertical direction of the entire flush toilet apparatus FT are small, and the design of the flush toilet apparatus FT is improved.

Figure 3:
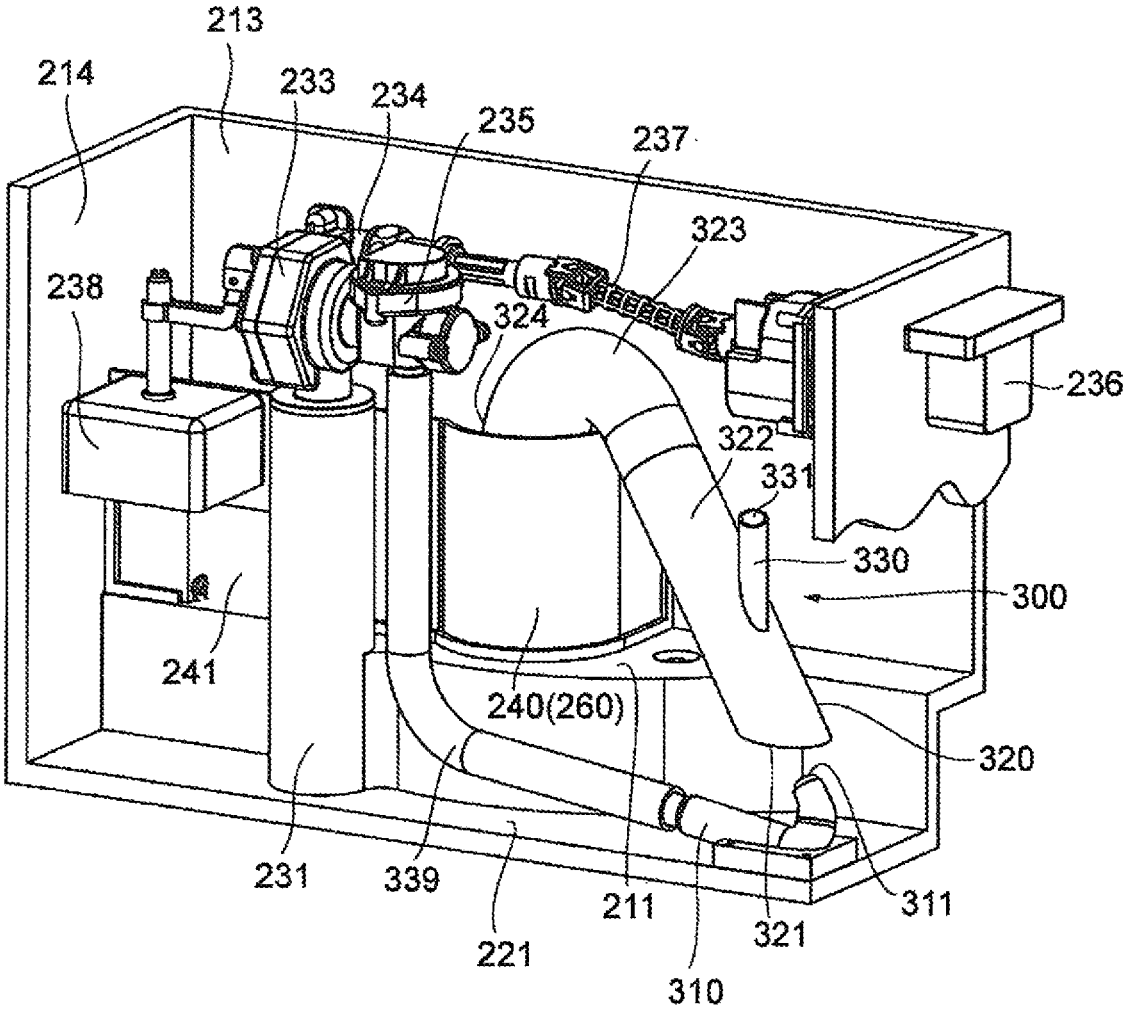
FIG. 3 is a diagram showing inside of a tank of the flush toilet apparatus shown in FIG. 1.

A configuration of the inside of the tank 20 will be described. FIG. 3 is a perspective view showing the inside of the tank 20 when the flush toilet apparatus FT is viewed from the backward side. As shown in FIG. 3, a water supply pipe 231, a main valve 233, a pilot valve 234, and the jet pump unit 300 are arranged inside of the tank 20.

The water supply pipe 231 is a pipe for supplying water toward the main valve 233 and is arranged to extend vertically upward from the bottom wall 221 of the second tank portion 220. A lower end of the water supply pipe 231 is connected to a water pipe not shown outside of the tank 20. An upper end of the water supply pipe 231 is connected to the main valve 233 from below, inside of the tank 20. The water supply pipe 231 is arranged at a position on the left side of the center in the horizontal direction of the inside of the tank 20.

A constant flow valve 232 not shown in FIG. 3 is arranged in the middle of the water supply pipe 231 (between the water pipe and the main valve 233). When the main valve 233 is open, the flow rate of water entering the main valve 233 is constant because of the constant flow valve 232, and the flow rate is not changed by the water pressure in the water pipe.

The main valve 233 is an open/close valve and is configured to open and close a channel of water from the water supply pipe 231 toward the jet pump unit 300. A vacuum breaker 235 is provided between the main valve 233 and the jet pump unit 300 to prevent the pressure from becoming negative in the upstream of the vacuum breaker 235 which leads to a reverse flow of water. The water supply pipe 231 extends above as described above, and the main valve 233 and the vacuum breaker 235 are arranged at high positions in the tank 20. Therefore, the vacuum breaker 235 is not submerged when the water level of the tank 20 is the full water level.

The pilot valve 234 is provided at the main valve 233, and the open/close of the main valve 233 is switched by the operation of the pilot valve 234. A manual lever 236 arranged outside of the tank 20 is connected to the pilot valve 234 through a transmission mechanism 237 arranged inside of the tank 20. A float 238 arranged inside of the tank 20 is further connected to the pilot valve 234.

When the user of the flush toilet apparatus FT operates the manual lever 236, the operation is transmitted to the pilot valve 234 through the transmission mechanism 237, and the pilot valve 234 is opened. As a result, the main valve 233 is opened, and the water flows from the water supply pipe 231 toward the jet pump unit 300. As described later, the water that flows toward the jet pump unit 300 is supplied to the water conduit 130 as wash water, along with the water stored in the tank 20. Therefore, the water level in the tank 20 gradually decreases.

The main valve 233 is not closed even after the washing of the bowl portion 110 is finished, and the water continuously flows from the water supply pipe 231 toward the jet pump unit 300. The water that flows toward the jet pump unit 300 is supplied inside of the tank 20 and stored for the next washing. When the water toward the inside of the tank 20 is supplied (water is poured into the tank 20), the water level in the tank 20 gradually rises. The float 238 connected to the pilot valve 234 inside of the tank 20 rises along with the rise in the water level, and as a result, the pilot valve 234 is closed.

In this way, when the water level in the tank 20 rises, the pilot valve 234 is closed by a change in the buoyance received by the float 238. When the pilot valve 234 is closed, the main valve 233 is closed, and the supply of water from the water supply pipe 231 to the jet pump unit 300 is stopped. The arrangement of the float 238 is adjusted so that the amount of water stored in the tank 20 at this point is an amount necessary for the next washing (predetermined full water level).

The jet pump unit 300 is configured to induce the jet pump action by the water supplied from the water supply pipe 231 to thereby supply the water toward the water conduit 130. The jet pump unit 300 includes a nozzle 310 and a throat pipe 320.

The nozzle 310 is a pipe in which one end is connected to the vacuum breaker 235 through a connection pipe 239, and an injection port 311 is formed on the other end. The nozzle 310 is arranged near the bottom wall 221 of the second tank portion 220. When the main valve 233 is opened, the water supplied from the water supply pipe 231 flows through the connection pipe 239 to reach the nozzle 310, and a high-speed water flow is injected from the injection port 311. The nozzle 310 is arranged on the backward side of the second tank portion 220, at a corner on the right side (corner in the view from the top). As shown in FIG. 3, the nozzle 310 has a U-shape, and the downstream of the nozzle 310 is folded back from the corner. The injection direction of the injection port 311 faces inside of the throat pipe 320.

The throat pipe 320 is a pipe with a round cross section and is arranged inside of the tank 20, with part of the throat pipe 320 penetrating through the opening 212 formed on the bottom wall 211. One end of the throat pipe 320 is connected to the inlet 131 of the water conduit 130, and a suction port 321, which is an opening, is formed on the other end. A part of the throat pipe 320 near the inlet 131 of the water conduit 130 is along the vertical direction, and a part near the suction port 321 is inclined relative to the horizontal surface. Therefore, the entire throat pipe 320 has an inverted U-shape. As shown in FIG. 2, the throat pipe 320 is arranged inside of the tank 20, inclined relative to the front-back direction in the view from the top.

A specific shape of the throat pipe 320 will be further described in detail. The throat pipe 320 includes: a rising portion 322 extending obliquely upward from the suction port 321; a curved portion 323 arranged on the downstream side (upper side) of the rising portion 322; and a falling portion 324 arranged on the downstream side (lower side) of the curved portion and extending downward from the curved portion 323.

The rising portion 322 is a cylindrical pipe in which the pipe diameter is uniform throughout the entire pipe, and the rising portion 322 is arranged to incline relative to the horizontal surface. The suction port 321 is formed at the lower end of the rising portion 322. The suction port 321 is formed so that the entire edge is along the horizontal surface (parallel to the horizontal surface).

The falling portion 324 is a cylindrical pipe in which the pipe diameter is uniform throughout the entire pipe, and the falling portion 324 is arranged in the vertical direction. The pipe diameter of the falling portion 324 is greater than the pipe diameter of the rising portion 322. The pipe diameter of the curved portion 323 near the rising portion 322 is equal to the pipe diameter of the rising portion 322. The pipe diameter of the curved portion 323 near the falling portion 324 is equal to the pipe diameter of the falling portion 324. Therefore, it can be stated that the rising portion 322 and the falling portion 324 with different pipe diameters are smoothly connected by the curved portion 323.

An air introduction pipe 330 is connected to a position substantially at the center of the rising portion 322 in the channel direction. The air introduction pipe 330 is a cylindrical pipe arranged in the vertical direction. The lower end of the air introduction pipe 330 is connected to the upper side of the rising portion 322, and the internal space of the air introduction pipe 330 and the internal space of the rising portion 322 are linked. An introduction port 331 is opened and formed on the upper end of the air introduction pipe 330, and air or water entered from the introduction port 331 can enter the internal space of the rising portion 322 through the air introduction pipe 330. The position (height) of the introduction port 331 is submerged when the water level of the tank 20 is the full water level. The position is higher than the suction port 321.

Figure 4:
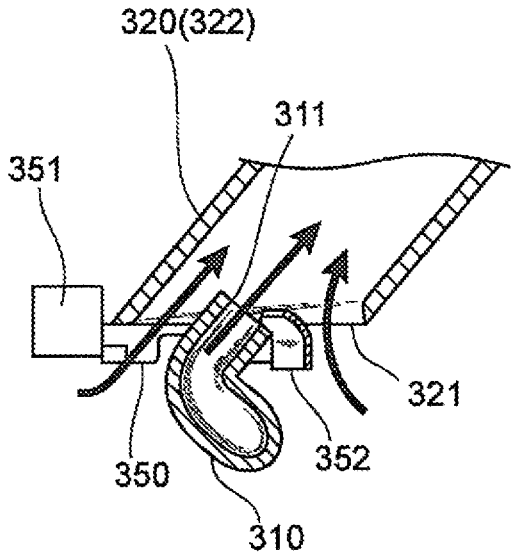
FIGS. 4A and 4B are diagrams for explaining operation of a jet pump unit arranged inside of the tank shown in FIG. 3.
Figure 4:
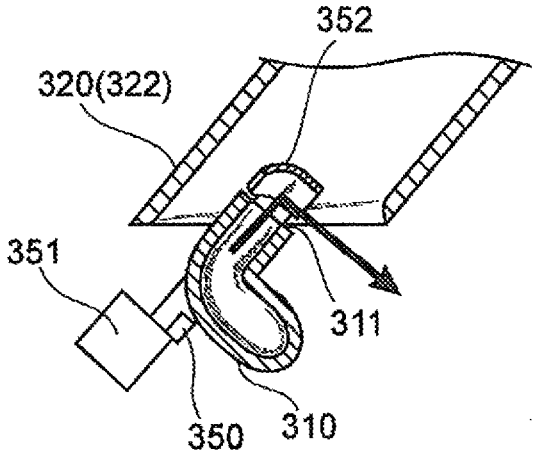

The configuration and operation of the jet pump unit 300 will be further described with reference to FIGS. 4A and 4B. FIG. 4A schematically shows a state in which water is injected from the nozzle 310 when the water level in the tank 20 is higher than the suction port 321 (for example, full water level), and the injection is inducing the jet pump action.

When the main valve 233 is opened to inject water from the injection port 311 of the nozzle 310, the injected high-speed water flows toward the inside of the rising portion 322. The lower side of the rising portion 322 and the nozzle 310 are submerged in the water stored in the tank 20. Therefore, the water stored in the tank 20 is drawn into the rising portion 322 by the high-speed water flow injected from the injection port 311, and the water flows toward the water conduit 130. As a result of the induction of the jet pump action, not only the water injected from the injection port 311 of the nozzle 310, but also the water drawn in from around the suction port 321 flows inside of the throat pipe 320. The water flows through the water conduit 130, and the water as wash water is supplied from the water ejection portions 133 and 135 to the rim portion 120.

In this way, the flow rate of the water supplied to the rim portion 120 is higher than the flow rate of the water injected from the injection port 311 of the nozzle 310 in the flush toilet apparatus FT. In other words, even if the flow rate of the water injected from the injection port 311 of the nozzle 310 is small, water at a sufficient flow rate is supplied to the rim portion 120 as wash water. Therefore, even if the flush toilet apparatus FT is installed in an environment with low water pressure in the water pipe, sufficient washing performance can be exerted.

The total amount of water supplied to the rim portion 120 (and the bowl portion 110) as wash water is equal to the sum of the amount of water stored in advance in the tank 20 and the amount of water injected from the injection port 311 of the nozzle 310. Since not all wash water needs to be stored in the tank 20, the tank 20 is downsized, and the design is improved.

By the way, water at a part below the suction port 321 of the water stored in the tank 20 is not supplied from the suction port 321 to the inside of the throat pipe 320. As a result, remained water remains in the tank 20. However, as shown in FIG. 3, etc., the nozzle 310 and the suction port 321 are arranged inside of the second tank portion 220 (narrow). Therefore, the amount of remained water remaining at the part below the suction port 321 is relatively small.

According to the configuration, the amount of remained water when the supply of water to the rim portion 120 is finished is small in the flush toilet apparatus FT. As a result, most of the internal space of the tank 20 can be used as a space for storing water supplied to the rim portion 120 (water that is not remained water), and the enlargement of the tank 20 is suppressed.

A channel switching member 350 is attached near the lower end of the rising portion 322, i.e. near the suction port 321. The channel switching member 350 is a rod-like member including a float 351 on one end in the longitudinal direction and a switching plate 352 on the other end. The channel switching member 350 is not illustrated in FIG. 3, etc., referenced above.

The part of the channel switching member 350 between the float 351 and the switching plate 352 is attached near the lower end of the rising portion 322, and the part can be freely rotated. As shown in FIG. 4A, the channel switching member 350 is rotated by the buoyance applied to the float 351 when the water level in the tank 20 is higher than the suction port 321. Specifically, the float 351 moves upward, and the switching plate 352 moves downward. The float 351 and the switching plate 352 stop at positions shown in FIG. 4A.

In the state of FIG. 4A, the water injected from the nozzle 310 enters inside of the rising portion without directly hitting the switching plate 352. As a result, the jet pump action as already described is induced, and the water as wash water is supplied to the rim portion 120.

Subsequently, the water in the tank 20 is supplied to the rim portion 120, and the water level in the tank 20 gradually decreases.

FIG. 4B schematically shows a state in which the water level in the tank 20 is reduced to near the suction port 321, and the supply of water to the rim portion 120 is stopped. When the water level in the tank 20 is reduced to near the suction port 321, the buoyance applied to the float 351 is small. Therefore, the channel switching member 350 rotates to move the float 351 downward as shown in FIG. 4B. The switching plate 352 moves upward, and the water injected from the nozzle 310 directly hits the switching plate 352.

The surface of the switching plate 352 facing the injection port 311 is curved in a concave shape. When the water injected from the nozzle 310 hits the surface, the water flows along the surface, and the travelling direction is changed by substantially 90 degrees. As a result, the water injected from the nozzle 310 does not enter inside of the rising portion 322, and the water is stored in the tank 20 for the next washing. In this way, the channel switching member 350 switches the supply destination of the water injected from the nozzle 310, from the rim portion 120 (toilet body 10) to the tank 20.

Figure 5:
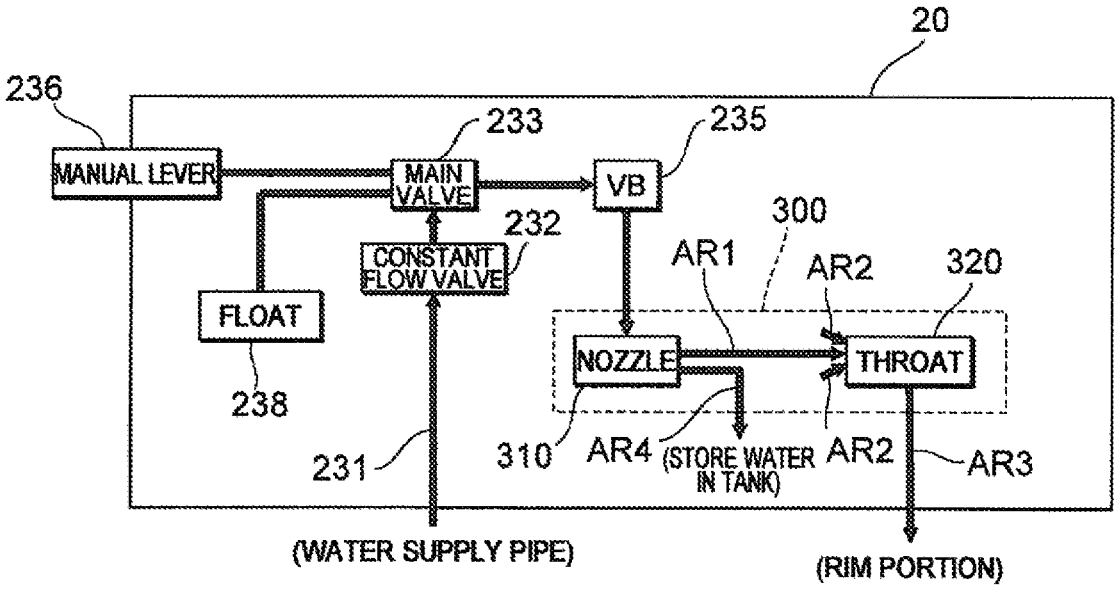
FIG. 5 is a diagram showing a configuration inside of the tank of the flush toilet apparatus shown in FIG. 1.

FIG. 5 schematically shows a configuration inside of the tank 20. As already described, the water supply pipe 231, the main valve 233, and the jet pump unit 300 are arranged inside of the tank 20.

In the state that the bowl portion 110 is not washed (standby state), the water level of the tank 20 is the full water level. When the user operates the manual lever 236 of the flush toilet apparatus FT, the main valve 233 is opened as already described, and water is injected from the injection port 311 of the nozzle 310 (arrow AR1 of FIG. 5). The water stored in the tank 20 is drawn into the throat pipe 320 (arrow AR2 of FIG. 5), and the water is supplied to the rim portion 120 as wash water (arrow AR3 of FIG. 5).

When the supply of water to the rim portion 120 is finished, the channel switching member 350 switches the supply destination of the water from the nozzle 310, and pouring of water into the tank 20 is started (arrow AR4 of FIG. 5). The water level in the tank 20 gradually rises, and the float 238 closes the pilot valve 234 at the full water level. At the same time, the main valve 233 is closed, and the pouring of water into the tank 20 is finished. The state returns to the standby state.

Another configuration inside of the tank 20 will be described with reference again to FIG. 3. As shown in FIG. 3, a partition wall 240 surrounding the falling portion 324 of the throat pipe 320 is arranged inside of the tank 20. The partition wall 240 is formed to extend upward from the bottom wall 211. Part of the internal space of the tank 20 is divided by the partition wall 240, a front wall surface 213 of the tank 20, a left wall surface 214, and the bottom wall 211 of the first tank portion 210, and a small tank 260 is formed. The small tank 260 is a container in which an upper part opens inside of the tank 20 and is arranged on the forward side of the first tank portion 210, at a corner on the left side. As for the throat pipe 320, a lower end part of the falling portion 324 is arranged inside of the small tank 260. The suction port 321 is arranged outside of the small tank 260.

An open/close window 241 is provided near a lower end portion of the partition wall 240. The open/close window 241 is usually open, and the inside and the outside (space on the backward side of the partition wall 240) of the small tank 260 are linked through the open/close window 241. Therefore, in a state that the bowl portion 110 is not washed (standby state), the water level of the water stored in the tank 20 and the water level of the water stored in the small tank 260 are equal.

The manual lever 236 can be operated in two directions (large direction and small direction). When the manual lever 236 is operated in the large direction, the pilot valve 234 and the main valve 233 are opened, while the open/close window 241 stays open. The water stored in the small tank 260 passes through the open/close window 241 and flows out to the second tank portion 220 to reach the suction port 321. Therefore, most of the water stored in the tank 20 including the water stored in the small tank 260 is drawn into the throat pipe 320 and supplied to the rim portion 120.

Meanwhile, when the manual lever 236 is operated in the small direction, the open/close window 241 is closed, and at the same time, the pilot valve 234 and the main valve 233 are opened. Therefore, of the water stored in the tank 20, the water stored in the small tank 260 cannot pass through the open/close window 241 and remains inside of the small tank 260. As a result, the amount of water supplied to the rim portion 120 as wash water is small.

In the following description, "the water level of the water stored in the tank 20", "the water level in the tank 20", or the like denotes the water level outside of the small tank 260. More specifically, this denotes the water level of the water stored in the space where the suction port 321 is arranged, of the two spaces divided by the partition wall 240. The water level of the water stored in the small tank 260 will not be taken into account in the following description.

Figure 6:
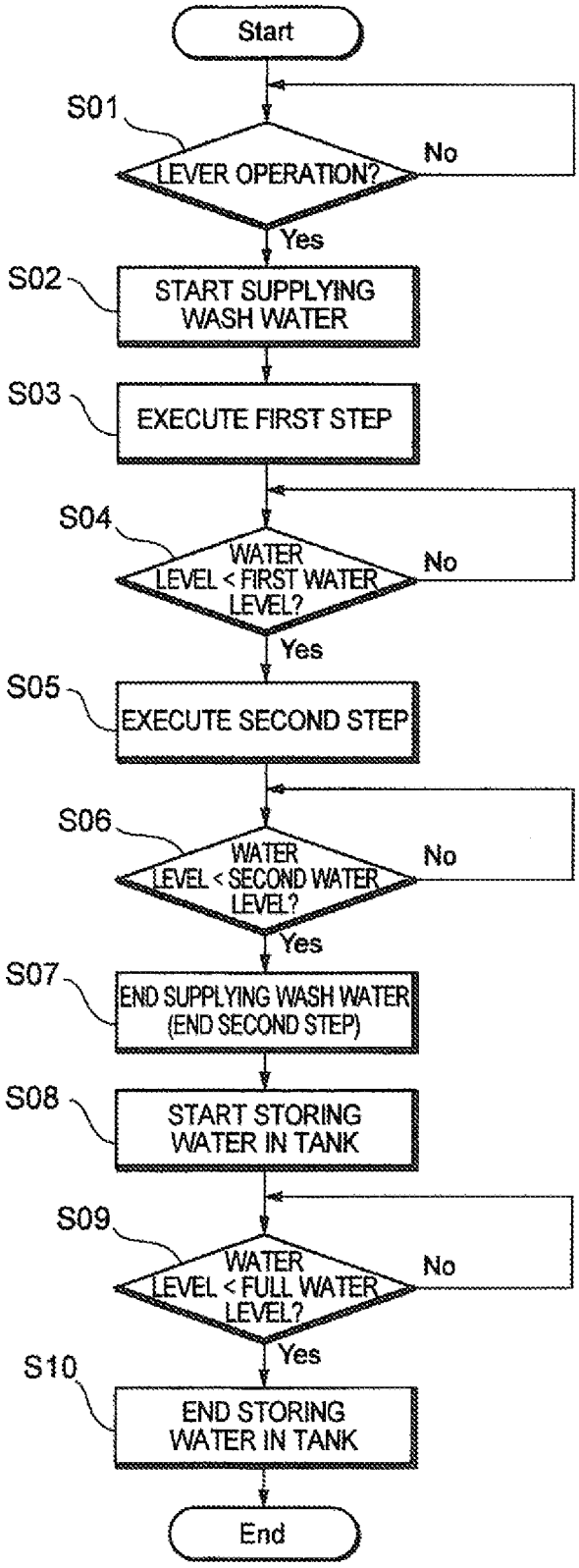
FIG. 6 is a flow chart for explaining a flow of operation during washing in the flush toilet apparatus shown in FIG. 1.
Figure 7:
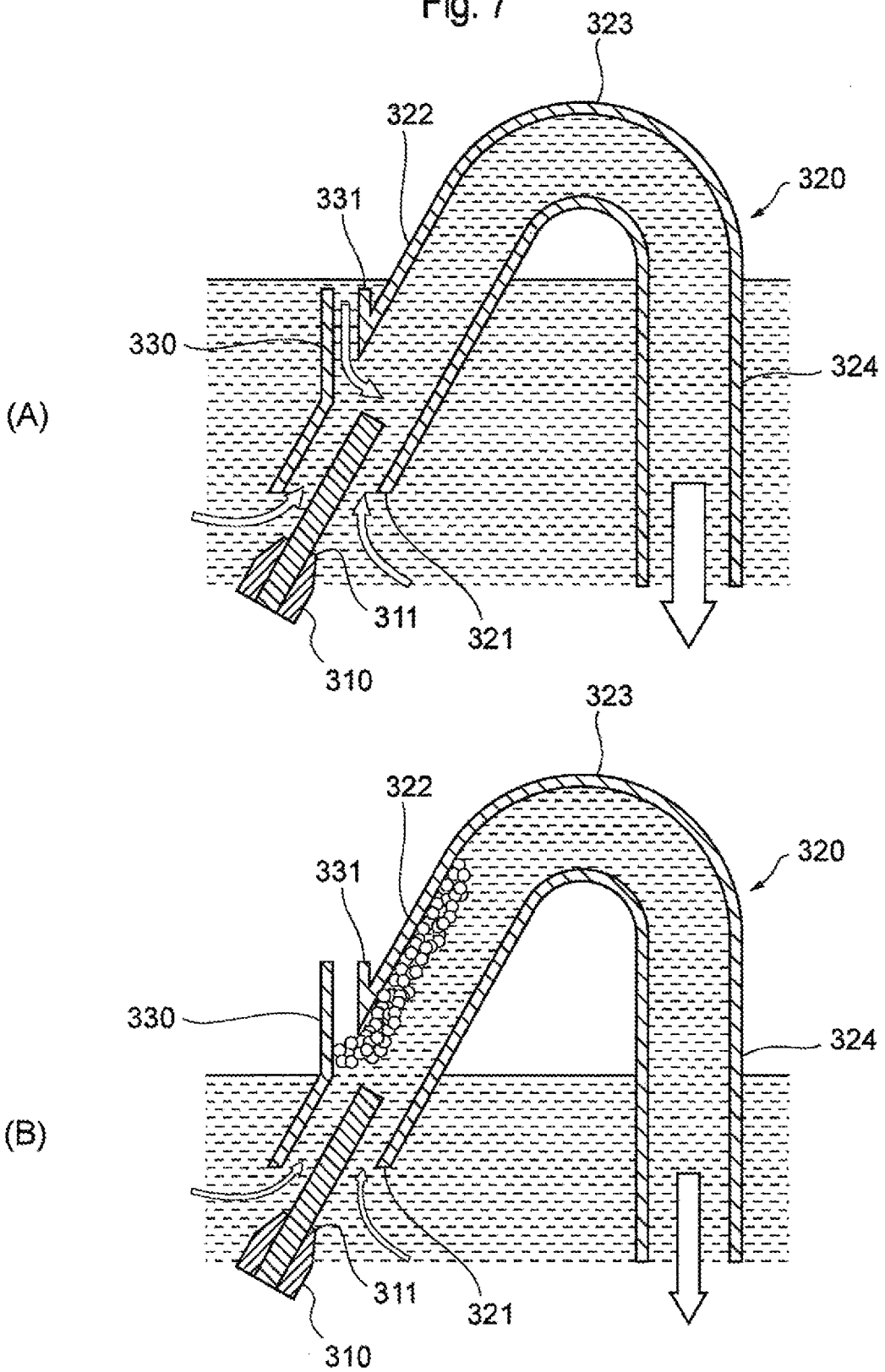
FIGS. 7A and 7B are diagrams for explaining that a flow rate of water supplied to a rim portion is changed by a switch in a channel state of the jet pump unit.
Figure 8:
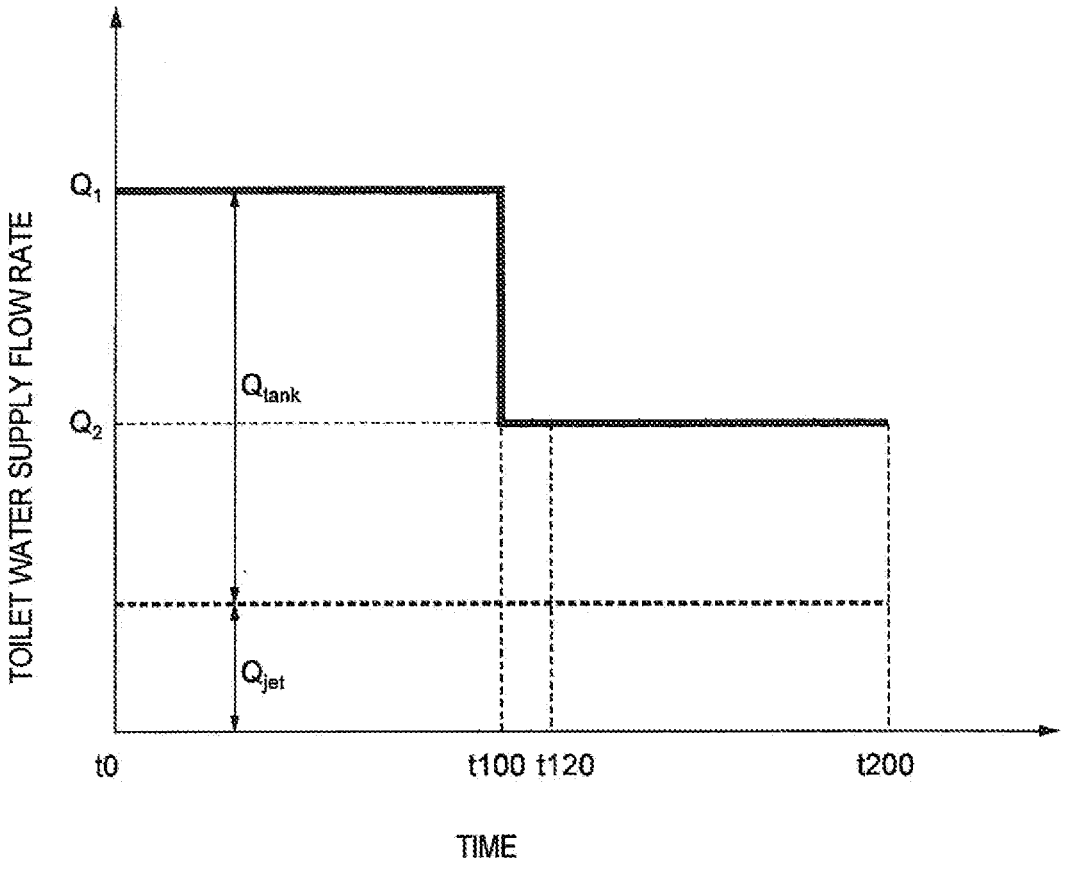
FIG. 8 is a graph showing a change in the flow rate of the water supplied to the rim portion.

Subsequently, the flow rate of the water supplied to the rim portion 120 as wash water (may also be referred to as the flow rate of the water supplied to the water ejection portions 133 and 135) will be described with reference to FIGS. 6 to 8. FIG. 6 is a flow chart for explaining a flow of operation during washing in the flush toilet apparatus FT. FIGS. 7A and 7B are diagrams for explaining a change in the flow rate of the water supplied to the rim portion 120, schematically showing a switch in the channel state of the jet pump unit 300. FIG. 8 is a graph showing the change in the flow rate of the water supplied to the rim portion 120.

When the user of the flush toilet apparatus FT operates the manual lever 236 (step S01), water is injected from the nozzle 310, and the water is supplied to the rim portion 120 by the jet pump action as already described (step S02).

FIG. 7A schematically shows a channel state of the jet pump unit 300 just after the supply of water to the rim portion 120 is started. Although the water level in the tank 20 is started to decrease from the full water level, the water level is higher than the introduction port 331 of the air introduction pipe 330. Therefore, the introduction port 331 is submerged.

In the rising portion 322, the water entered from the suction port 321 flows toward the curved portion 323. The water flow generates negative pressure in the water inside of the air introduction pipe 330, and the water is drawn into the rising portion 322. As a result, not only the water entered from the suction port 321, but also the water entered from the introduction port 331 flows inside of the rising portion 322. Therefore, a large amount of water caused by the jet pump action is supplied to the rim portion 120 as wash water.

A large amount of water is supplied to the rim portion 120 as described above in a period from the start of the injection of water from the nozzle 310 to the time that the water level in the tank 20 is at the position of the introduction port 331 after the decrease in the water level (water level at this point will also be called "first water level"). A step of supplying a large amount of water from the jet pump unit 300 in the period will also be called a "first step" (step S03). The first step is a step of forming a water flow by providing momentum to the water stored in the bowl portion 110 in the resting state, and the first step will also be called a water flow forming step.

When the water level in the tank 20 decreases to the first water level, the first step ends (step S04). In this case, although the negative pressure is still generated by the water flow inside of the rising portion 322 (near the lower end portion of the air introduction pipe 330), the introduction port 331 appears above the water surface (not submerged). Therefore, air, not water, enters from the introduction port 331.

FIG. 7B schematically shows a channel state of the jet pump unit 300 in this case. Water is continuously injected from the nozzle 310, and a water flow is generated by the jet pump action inside of the throat pipe 320. However, air from the air introduction pipe 330 is mixed with the water flow.

As a result, compared to the state shown in FIG. 7A, the air mixed inside of the throat pipe 320 suppresses the jet pump action, and the flow rate of the water flowing inside of the throat pipe 320 is reduced in FIG. 7B. Therefore, the flow rate of the water supplied to the rim portion 120 is lower than the flow rate in the first step. In this way, a step of supplying water at the decreased flow rate (due to the suppression of the jet pump action) to the rim portion 120 as wash water after the end of the first step will also be called a "second step" (step S05). The second step is a step of continuously supplying water to the water ejection portion to maintain the water flow in the bowl portion 110 formed in the first step, and the second step will also be called a water flow maintaining step. The second step continues until the channel switching member 350 is in the state shown in FIG. 4B after further decrease in the water level in the tank 20 (steps S06 and S07).

The water level in the tank 20 when the channel switching member 350 rotates and enters the state shown in FIG. 4B after the reduction in the buoyance applied to the float 351 of the channel switching member 350 will also be called a "second water level". More specifically, the second water level is the water level in the tank 20 when the supply of wash water to the rim portion 120 is stopped.

When the second step is finished, water is continuously injected from the nozzle 310 as already described, and the water is stored in the tank 20 (step S08). When the water level in the tank 20 rises and reaches the full water level, the injection of water from the nozzle 310 is stopped, and the storage of water in the tank 20 is stopped (steps S09 and S10).

Water (refill water) for forming the sealing water WT may be added and supplied from the jet pump unit 300 to the rim portion 120 after the bowl portion 110 is washed. It is desirable that the supply of the refill water is started at a timing of one of the point that the second step is finished (just after step S07) and the point that the storage of water in the tank 20 is stopped (just after step S10). When the supply of the refill water is started at the point that the second step is finished, the storage of water in the tank 20 and the addition of refill water to the rim portion 120 are performed at the same time.

FIG. 8 shows a change in the flow rate of the water supplied to the rim portion 120 in a period from the start of the first step (time t0) to the end of the second step (t200). Therefore, FIG. 8 shows a change in the flow rate of the wash water supplied to the rim portion 120 in the period that the bowl portion 110 is washed. In FIG. 8, the time that the first step is switched to the second step, i.e. the time that the water level in the tank 20 becomes the first water level, is time t100. The flow rate of the water injected from the nozzle 310 is written as Qjet, and the flow rate of the water drawn into the suction port 321 by the jet pump action (water drawn from the tank 20 into the throat pipe 320) is written as Qtank.

As already described, in the first step from the time t0 to the time t100, a large amount of water caused by the jet pump action is supplied to the rim portion 120. As shown in FIG. 8, the flow rate of the water reaching the rim portion 120 is a sum of the flow rate Qjet and the flow rate Qtank. In other words, the flow rate Qjet is amplified by the jet pump action to derive the flow rate.

In the second step from the time t100 to the time t200, the water at the flow rate amplified by the jet pump action reaches the rim portion 120, as in the first step. However, the jet pump action is suppressed by mixing of bubbles inside of the throat pipe 320 in the second step. More specifically, although the flow rate Qjet of the water injected from the nozzle 310 remains constant after the switch to the second step, the flow rate Qtank of the water drawn into the suction port 321 decreases at the same time as the switch to the second step. As a result, the flow rate (sum of the flow rate Qjet and the flow rate Qtank) of the water supplied from the jet pump unit 300 to the rim portion 120 rapidly decreases after the time t100 (changed from flow rate Q1 to flow rate Q2).

The introduction port 331 is submerged in the tank 20 in the first step from the time t0 to the time t100. Therefore, the jet pump action is not suppressed, and a large amount of water is supplied at substantially a constant flow rate from the jet pump unit 300 to the rim portion 120 (water ejection portions 133 and 135). The waste attached to the bowl portion 110 is removed in a short time.

The introduction port 331 is not submerged in the tank 20 in the second step from the time t100 to the time t200. Therefore, the jet pump action is suppressed by the bubbles mixed from the air introduction pipe 330, and the flow rate of the water supplied to the rim portion 120 decreases (changes from the flow rate Q1 to the flow rate Q2). In this way, the air introduction pipe 330 functions as "channel state switching portion" for switching the channel state of the jet pump unit 300 to suppress the jet pump action.

The timing of the transition from the first step to the second step is taken into account to determine the position (height) of the introduction port 331. Appropriate suppression of the jet pump is taken into account to determine the position of the lower end of the air introduction pipe 330. Although the determined positions are usually different, the length of the air introduction pipe 330 may be 0 if the positions coincide. More specifically, a through hole may be formed on the wall surface of the throat pipe 320, and the air may be introduced from the through hole. In this case, the position of the through hole is the position of the introduction port 331 and is the position where the air is mixed with the water flow in the throat pipe 320.

As described above, the flow rate of the water supplied to the rim portion 120 decreases in the second step following the first step in the flush toilet apparatus FT according to the present embodiment. Therefore, the flow rate of the water supplied to the bowl portion 110 decreases in the second step.

As already described, wash water at a constant flow rate is always supplied to the bowl portion 110 when the jet pump unit 300 is mounted on the toilet body 10.

However, the flow rate of the minimum wash water necessary to discharge waste in the wash-down toilet body 10 is not always constant from the start to the end of washing, and the minimum wash water changes with time.

Specifically, at the start of washing, the water stored in the bowl portion 110 in the resting state needs to be provided with momentum to form the water flow, and a large amount (first flow rate) of wash water needs to be supplied. However, in the middle of washing following the start of washing, the water flow is already formed in the bowl portion 110, and inertia force is acting in the water. Therefore, the flow rate of the water necessary to maintain the water flow in the bowl portion 110 is lower than the first flow rate.

Therefore, if water at a constant flow rate is always supplied from the start to the end of washing, more than necessary amount of wash water is supplied, and part of the wash water is wasted.

Thus, if the water flow forming and maintaining steps are sequentially executed, and the flow rate of the water supplied to the water ejection portions 133 and 135 is reduced (changed from the first flow rate to the second flow rate) as in the flush toilet apparatus FT according to the present embodiment, water can be saved without sacrificing the washing performance.

The reduction in the flow rate of water is advantageous in that light waste floating in the bowl portion 110, which is unlikely to be discharged when a large amount (first flow rate) of water is supplied, is easily discharged. It is preferable to reduce the flow rate of the water to ensure the discharge performance of the light waste.

In this way, the discharge performance of the waste can be ensured, and the total amount of wash water supplied to the bowl portion 110 can be reduced throughout the entire period of supplying wash water (from time t0 to time t200) in the flush toilet apparatus FT according to the present embodiment, even though the jet-pump water supply mechanism is mounted on the wash-down toilet body. As a result, the water saving capacity can be improved without sacrificing the washing performance.

The place for mixing the bubbles inside of the throat pipe 320 can be the falling portion 324, instead of the rising portion 322 as in the present embodiment. However, if the air is mixed in the falling portion 324, the water in the tank 20 cannot be at the full water level. This is because the introduction port 331 is submerged when the water in the tank 20 is at the full water level, and the water entering the falling portion 324 from the introduction port 331 is directly supplied to the rim portion 120 by the gravity.

Therefore, the air is mixed at a place on the upstream side of the falling portion 324 in the flush toilet apparatus FT. The configuration prevents the water in the tank 20 from entering the throat pipe 320 from the introduction port 331 and directly flowing out toward the toilet body 10 when the toilet body 10 is not washed.

Figure 9:
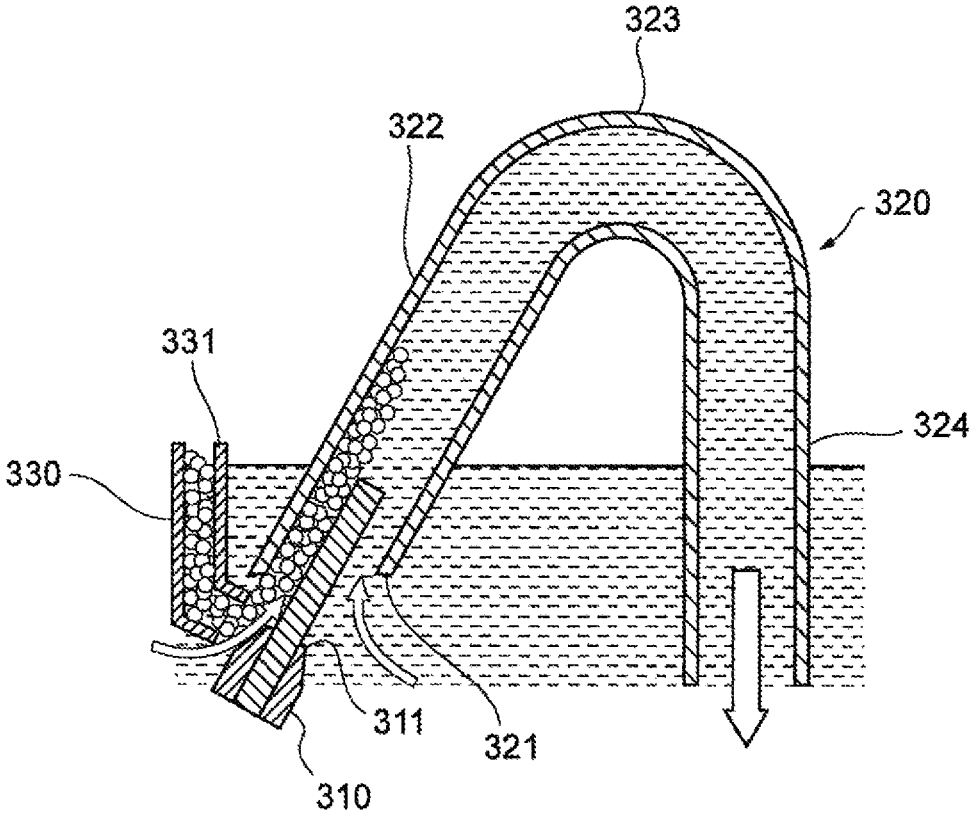
FIG. 9 is a diagram for explaining a case in which an air introduction pipe is arranged on another position.

The place for mixing the bubbles inside of the throat pipe 320 can be on the upstream side of the suction port 321 as shown for example in FIG. 9. In this case, the lower end of the air introduction pipe 330 is arranged at a position between the nozzle 310 and the suction port 321. However, according to the configuration, the lower end of the air introduction pipe 330 may inhibit the flow of the water entering inside of the throat pipe 320 from the suction port 321, and the jet pump action may be inhibited. As a result, the flow rate of the water supplied to the rim portion 120 may decrease (particularly in the first step).

Therefore, the air introduced from the introduction port 331 of the air introduction pipe 330 is mixed with the water flow generated by the jet pump action at a position on the downstream side of the suction port 321 in the flush toilet apparatus FT. The configuration can prevent the air introduction pipe 330 from inhibiting the flow of the water entering inside of the throat pipe 320 from the suction port 321. As a result, the jet pump action in the first step is not inhibited, and a large amount of water is supplied to the rim portion 120. Therefore, high washing performance can be ensured.

Channel state switching portion can, for example, change the channel state of the upstream of the suction port 321 in the jet pump unit 300 to thereby suppress the jet pump action in the second step. For example, the flow rate Qjet of the water injected from the nozzle 310 can be reduced to suppress the jet pump action in the second step. In addition, the channel resistance of the part between the nozzle 310 and the suction port 321 can be increased to suppress the jet pump action in the second step.

However, the flow rate of the water flowing inside of the throat pipe 320 is derived by increasing (amplifying) the flow rate Qjet of the water injected from the nozzle 310 by the jet pump action. Therefore, the flow rate of the water flowing inside of the throat pipe 320 is significantly reduced by slightly reducing the flow rate Qjet of the water injected from the nozzle 310. Similarly, the flow rate of the water flowing inside of the throat pipe 320 is significantly reduced by slightly increasing the channel resistance of the part between the nozzle 310 and the suction port 321.

In this way, it is not easy to change the channel state of the upstream of the suction port 321 to change the flow rate Q1 to the appropriate flow rate Q2 (see FIG. 8). According to such a mode, the flow rate of the water supplied to the rim portion 120 in the second step may be too low, and necessary washing performance may not be ensured.

Therefore, the channel state switching portion in the flush toilet apparatus FT switches the channel state on the downstream side of the nozzle 310 and the suction port 321 of the jet pump unit 300 (inside of the rising portion 322 in the present embodiment). According to the configuration, it is easy to appropriately adjust the flow rate of the water flowing inside of the throat pipe 320. This prevents the flow rate of the water supplied to the rim portion 120 in the second step from becoming too low.

Channel state switching portion can, for example, change the channel state of the falling portion 324 of the jet pump unit 300 to thereby suppress the jet pump action in the second step. However, the flow velocity of the water flowing inside of the falling portion 324 is relatively slow (high-speed water injected from the nozzle 310 and the water in the tank 20 conveyed due to the high-speed water are sufficiently mixed, and the flow velocity is slower than the flow velocity of the water injected from the nozzle 310 as a result of the equalization of the flow velocity in the channel cross section). Therefore, for example, an increase in the channel resistance of the falling portion 324 in some degree only slightly reduces the flow rate. In this way, it is difficult to change the channel state of the falling portion 324 to suppress the jet pump action in the second step.

Therefore, the channel state switching portion in the flush toilet apparatus FT switches the channel state on the upstream side of the falling portion 324 in the jet pump unit 300 (inside of the rising portion 322 in the present embodiment). The configuration further facilitates the channel state switching portion to switch the channel state to appropriately adjust the flow rate of the water flowing inside of the throat pipe 320.

Figure 10:
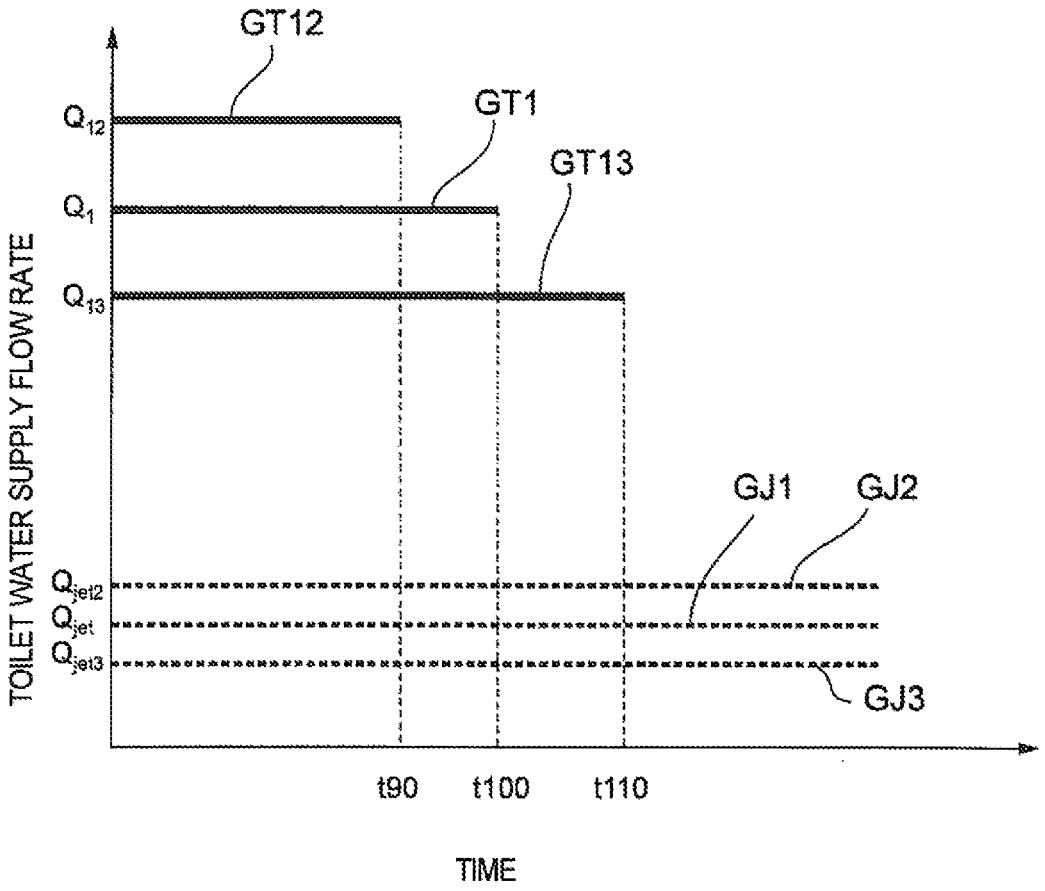
FIG. 10 is a diagram for explaining influence of variations in the flow rate of the water supplied to the rim portion.

Subsequently, influence of variations in the flow rate of the water injected from the nozzle 310 will be described with reference to FIG. 10. A graph GJ1 of FIG. 10 indicates a temporal change in the flow rate of the water injected from the nozzle 310. As already described, the water is injected from the nozzle 310 at the constant flow rate Qjet. A graph GT1 indicates a flow rate of the water supplied to the rim portion 120 by the jet pump action. The flow rate Qjet is amplified by the jet pump action in the first step, and as a result, water at the flow rate Q1 is supplied to the rim portion 120. FIG. 10 does not depict a graph indicating the flow rate of the water supplied to the rim portion 120 after the time t100 (second step).

The flow rate of the water supplied to the rim portion 120 by the jet pump unit 300 may not be strictly as in the design value (Qjet) due to, for example, the machine difference in the constant flow valve 232 arranged on the upstream side of the nozzle 310, and the flow rate may vary between products. A graph GJ2 of FIG. 10 indicates a temporal change in the flow rate when the flow rate of the water injected from the nozzle 310 is not as in the design value and is a flow rate Qjet2 slightly higher than the flow rate Qjet. In this case, the flow rate of the water supplied to the toilet body 10 is a flow rate Q12 higher than the flow rate Q1 as indicated by a graph GT12.

In the present embodiment, the first step ends when the water level in the tank 20 decreases to the first water level (introduction port 331), and the first step is switched to the second step. Therefore, the first step ends before the time t100 (time t90) when the flow rate of the water supplied to the rim portion 120 increases from the flow rate Q1 to the flow rate Q12.

A graph GJ3 of FIG. 10 indicates a temporal change in the flow rate when the flow rate of the water injected from the nozzle 310 is not as in the design value and is a flow rate Qjet3 slightly lower than the flow rate Qjet. In this case, the flow rate of the water supplied to the rim portion 120 is a flow rate Q13 lower than the flow rate Q1 as indicated by a graph GT13.

As is clear from FIG. 10, if the first step ends at the time t100 in such a case, the first step is switched to the second step in a state that the flow rate of the water supplied to the rim portion 120 is not sufficient. Therefore, the flow rate of the water supplied to the bowl portion 110 decreases in a state that the flow rate of the water supplied to the bowl portion 110 is not sufficient. In this case, the washing performance in the first step is not sufficient, and the washing performance of the bowl portion 110 cannot be ensured.

In the present embodiment, the first step continues until the water level in the tank 20 decreases to the first water level (introduction port 331). Therefore, the first step continues until a point later than the time t100 (time t110) when the flow rate of the water supplied to the toilet body 10 is reduced from the flow rate Q1 to the flow rate Q13. As a result, the washing performance of the bowl portion 110 in the first step is sufficiently ensured.

In this way, the greater the flow rate of the water supplied to the rim portion 120 in the first step, the earlier the timing of transition from the first step to the second step in the present embodiment. More specifically, the timing of transition from the first step to the second step (length of the period of the first step) is not fixed, and the timing changes according to the flow rate of the water supplied to the rim portion 120 in the first step. According to the configuration, the timing of transition from the first step to the second step is adjusted to be appropriate according to the change even if the flow rate of the water supplied to the rim portion 120 is changed in the first step.

According to the configuration of switching the first step to the second step when the water level in the tank 20 decreases to the first water level (introduction port 331), the adjustment is automatically performed at the timing described above. Therefore, the timing of transition from the first step to the second step is appropriately and automatically adjusted without directly measuring the flow rate of the water supplied to the rim portion 120 in the first step. Thus, an apparatus such as a flowmeter is not necessary, and the timing of transition to the second step is appropriately and automatically adjusted with a simple configuration.

Subsequently, a flush toilet apparatus FTa according to a second embodiment of the present invention will be described. Although the arrangement and the number of air introduction pipes connected to a throat pipe 320*a* in the flush toilet apparatus FTa are different from those of the flush toilet apparatus FT, other configurations are the same as those of the flush toilet apparatus FT. Therefore, the same configurations as those of the flush toilet apparatus FT will not be described.

As shown in FIG. 11A, two air introduction pipes (first air introduction pipe 330*a* and second air introduction pipe 340*a*) are connected to the throat pipe 320*a* of the flush toilet apparatus FTa. These are cylindrical pipes arranged in the vertical direction, and the lower ends are connected to the upper side of a rising portion 322*a* of the throat pipe 320*a*.

The first air introduction pipe 330*a* has the same shape as the air introduction pipe 330 of the flush toilet apparatus FT and is arranged at the same position. An introduction port 331*a* is opened and formed on the upper end of the first air introduction pipe 330*a*, and air or water entered from the introduction port 331*a* can enter the internal space of the rising portion 322*a* through the first air introduction pipe 330*a*. The position (height) of the introduction port 331*a* is submerged when the water level of a tank 20*a* is the full water level. The position is higher than a suction port 321*a*.

The second air introduction pipe 340*a* has the same shape as the first air introduction pipe 330*a* and is connected to a position of the rising portion 322*a* on the upstream side of the first air introduction pipe 330*a*. An introduction port 341*a* is opened and formed on the upper end of the second air introduction pipe 340*a*, and air or water entered from the introduction port 341*a* can enter the internal space of the rising portion 322*a* through the second air introduction pipe 340*a*. The position (height) of the introduction port 341*a* is at a position lower than the introduction port 331*a* and higher than the suction port 321*a*.

Figure 11:
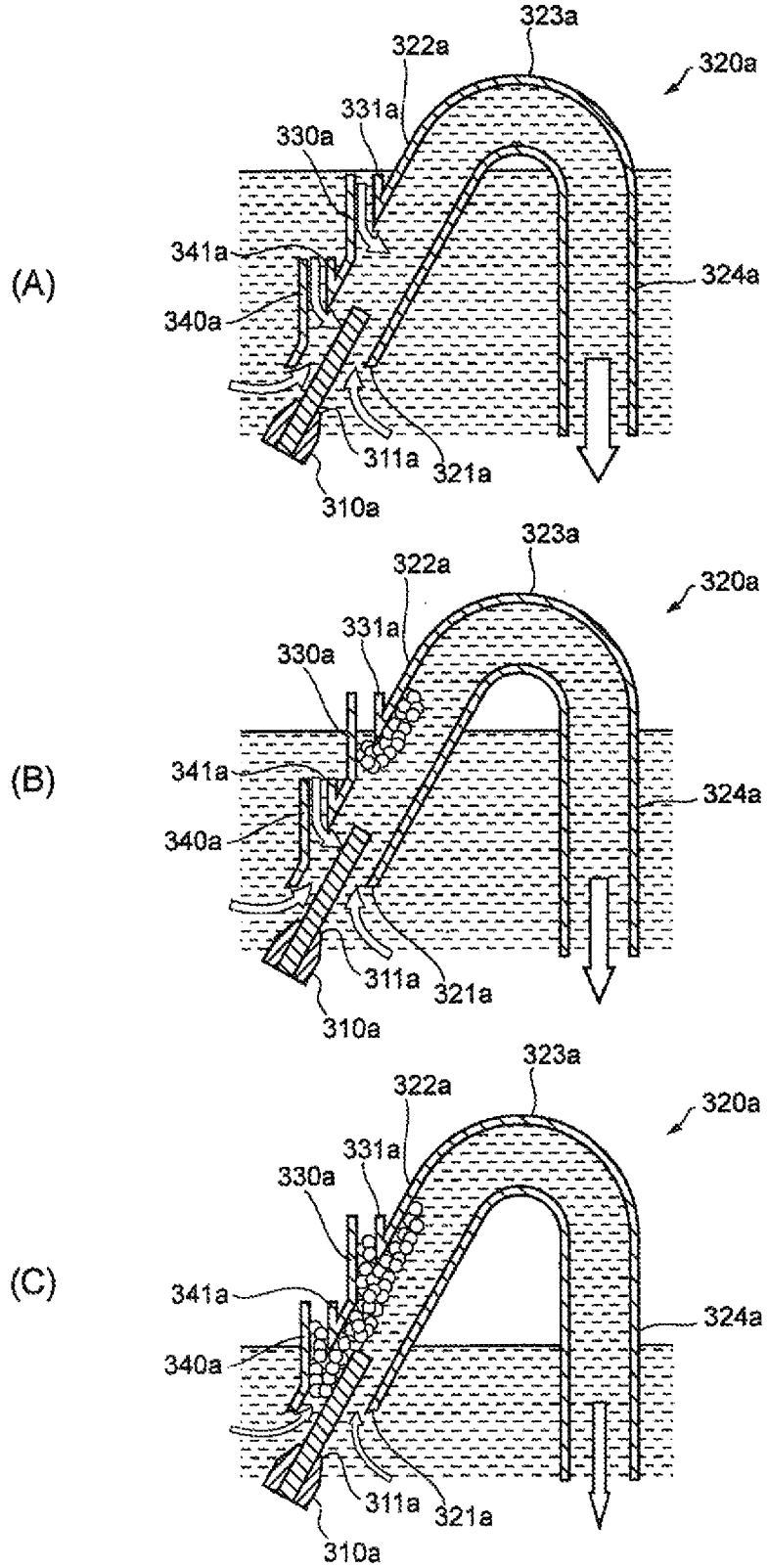
FIGS. 11A, 11B, and 11C are diagrams for explaining a configuration and operation of a jet pump unit of a flush toilet apparatus according to a second embodiment of the present invention.
Figure 12:
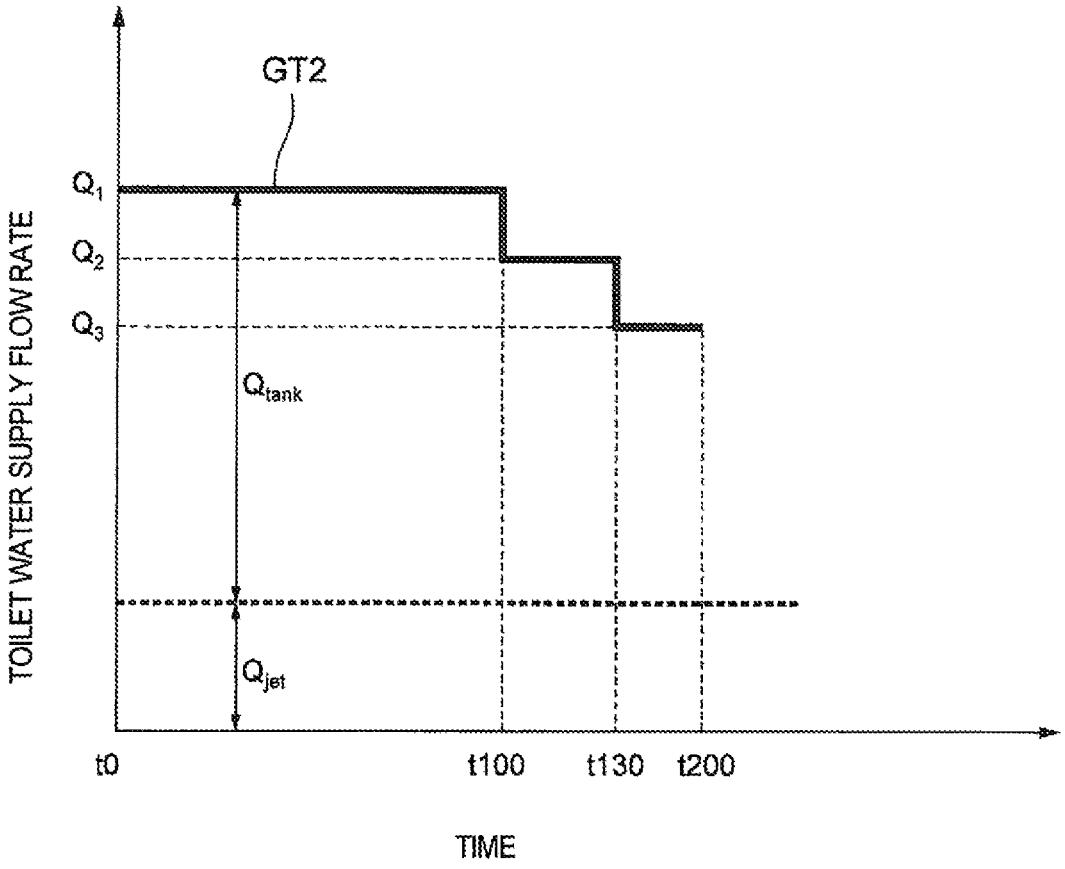
FIG. 12 is a graph showing a change in the flow rate of the water supplied from the jet pump unit shown in FIGS. 11A, 11B, and 11C to a rim portion.

The flow rate of water supplied to a rim portion 120*a* as wash water will be described with reference to FIGS. 11A to 12. FIGS. 11A, 11B, and 11C are diagrams for explaining a structure and operation of a jet pump unit 300*a*, schematically showing a switch in the channel state of the jet pump unit 300*a*. FIG. 12 is a graph showing a change in the flow rate of the water supplied to the rim portion 120*a*.

FIG. 11A schematically shows the channel state of the jet pump unit 300*a* just after the supply of water to the rim portion 120*a* is started. Although the water level in the tank 20*a* is started to decrease from the full water level, the water level is higher than the introduction port 331*a* of the first air introduction pipe 330*a*. Therefore, the introduction port 331*a* and the introduction port 341*a* are both submerged.

The water entered from the suction port 321*a* flows toward a curved portion 323*a* inside of the rising portion 322*a*. The water flow generates negative pressure in the water inside of the first air introduction pipe 330*a*, and the water is drawn into the rising portion 322*a*. Similarly, the negative pressure also acts on the water inside of the second air introduction pipe 340*a*, and the water is drawn into the rising portion 322*a*. As a result, not only the water entered from the suction port 321*a*, but also the water entered from the introduction port 331*a* and the introduction port 341*a* flows inside of the rising portion 322*a*. Therefore, a large amount of water caused by the jet pump action is supplied to the rim portion 120*a* as wash water. A large amount (flow rate: Q1) of water is supplied to the rim portion 120*a* as described above in the period from the start of the injection of water from a nozzle 310*a* (time t0) to the time that the water level in the tank 20*a* is at the position (first water level) of the introduction port 331*a* after the decrease in the water level (time t100).

As in the flush toilet apparatus FT, when the water level in the tank 20*a* decreases to the first water level (position of the introduction port 331*a*), the first step ends, and the first step is switched to the second step. In this case, although the negative pressure is still generated by the water flow inside of the rising portion 322*a* (near the lower end portion of the first air introduction pipe 330*a*), the introduction port 331*a* appears above the water surface (not submerged). Therefore, air, not water, enters from the introduction port 331*a*. On the other hand, the introduction port 341*a* is still submerged, and water continuously enters from the introduction port 341*a*.

FIG. 11B schematically shows the channel state of the jet pump unit 300*a* in this case. The water is continuously injected from the nozzle 310*a*, and the water flow is generated by the jet pump action inside of the throat pipe 320*a*. However, the air from the first air introduction pipe 330*a* is mixed with the water flow. The air mixed inside of the throat pipe 320*a* suppresses the jet pump action, and the flow rate of the water flowing inside of the throat pipe 320*a* is reduced in FIG. 11B. More specifically, the flow rate (flow rate: Q2) of the water supplied to the rim portion 120*a* is lower than the flow rate (flow rate: Q1) in the first step.

Subsequently, when the water level in the tank 20*a* further decreases to the position of the introduction port 341*a* (time t130), the air also enters from the introduction port 341*a*. Therefore, in addition to the air from the first air introduction pipe 330*a*, the air from the second air introduction pipe 340*a* is also started to be mixed with the water flow inside of the throat pipe 320*a*.

FIG. 11C schematically shows the channel state of the jet pump unit 300*a* in this case. The water is continuously injected from the nozzle 310*a*, and the water flow is generated by the jet pump action inside of the throat pipe 320*a*. However, more air is mixed with the water flow. The mixed air further suppresses the jet pump action, and the flow rate of the water flowing inside of the throat pipe 320*a* is further reduced in FIG. 11C. More specifically, the flow rate (flow rate: Q3) of the water supplied to the rim portion 120*a* is further reduced from the flow rate in FIG. 11B (flow rate: Q2).

Subsequently, the water level in the tank 20*a* further decreases, and the water is supplied to the rim portion 120*a* until the water level reaches the second water level. When the water level in the tank 20*a* decreases to the second water level, the second step ends, and the storage of water in the tank 20*a* is started by the operation of a channel switching member 350*a*.

As is clear from the above description and FIG. 12, the jet pump action is suppressed at the point of the switch from the first step to the second step (time t100), and the flow rate of the water supplied to the rim portion 120*a* rapidly decreases in the present embodiment. The jet pump action is suppressed again in the middle of the period of the second step (time t130), and the flow rate of the water supplied to the rim portion 120*a* further decreases in the present embodiment.

In this way, the largest possible amount of water is supplied to the rim portion 120*a* at a constant rate in the first step (up to time t100), and the flow rate is reduced in stages in the second step (after time t100).

Figure 13:
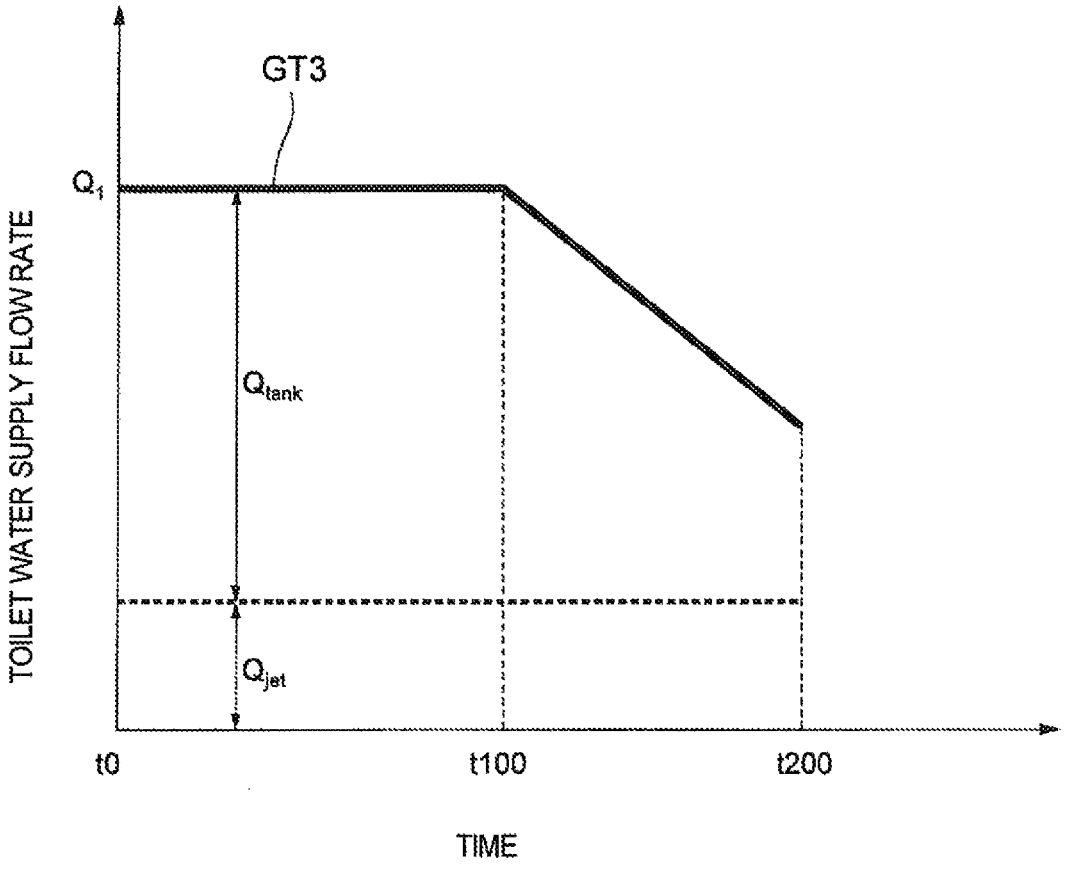
FIG. 13 is a graph showing a change in the flow rate of the water supplied to the rim portion when an air introduction pipe is further added.

The number of air introduction pipes is not limited to two, and the number may be further increased. More specifically, three or more air introduction pipes may be connected to the throat pipe 320*a*, and the height of the upper end (introduction port) of each air introduction pipe may be different. According to the configuration, when the amount of water supplied to the rim portion 120*a* is reduced in stages in the second step, the number of stages can be further increased. For example, the flow rate of the water supplied to the rim portion 120*a* in the second step can be changed substantially smoothly as in a graph GT3 shown in FIG. 13.

Subsequently, a flush toilet apparatus FTb according to a third embodiment of the present invention will be described. Although the shape and the material of an air introduction pipe connected to a throat pipe 320*b* in the flush toilet apparatus FTb are different from those of the flush toilet apparatus FT, other configurations are the same as those of the flush toilet apparatus FT. Therefore, the same configurations as those of the flush toilet apparatus FT will not be described.

Figure 14:
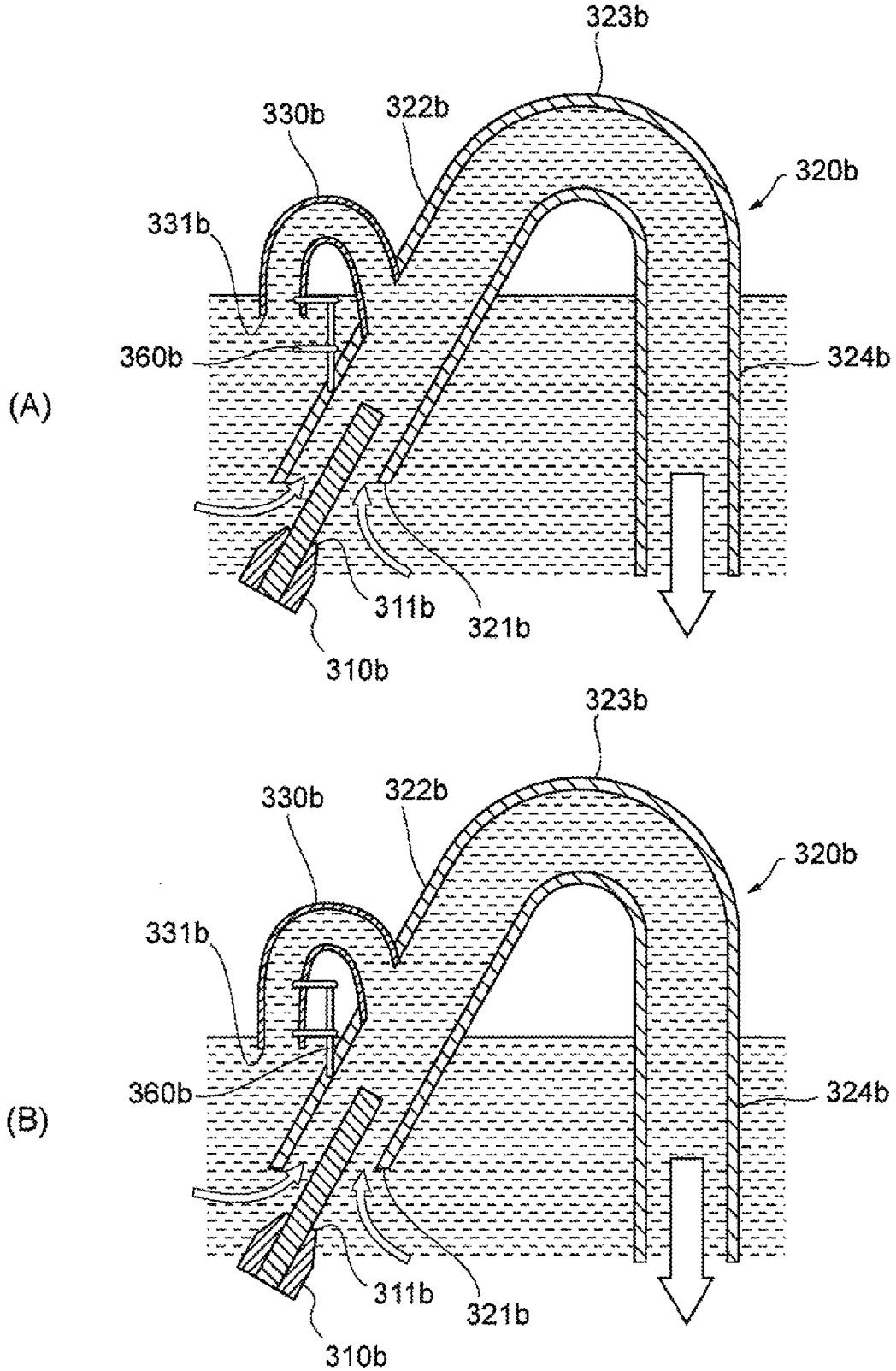
FIGS. 14A and 14B are diagrams for explaining a configuration of a jet pump unit of a flush toilet apparatus according to a third embodiment of the present invention.

FIGS. 14A and 14B are diagrams for explaining a configuration of a jet pump unit 300*b* in the flush toilet apparatus FTb. As shown in FIG. 14A, an air introduction pipe 330*b* is connected to a position substantially at the center of a rising portion 322*b* in the channel direction. The air introduction pipe 330*b* is a cylindrical pipe formed by a flexible resin. One end of the air introduction pipe 330*b* is connected to the upper side of the rising portion 322*b*, and the internal space of the air introduction pipe 330*b* and the internal space of the rising portion 322*b* are linked. An introduction port 331*b* is opened and formed on the other end of the air introduction pipe 330*b*, and air or water entered from the introduction port 331*b* can pass through the air introduction pipe 330*b* to enter the internal space of the rising portion 322*b*.

A holding member 360*b* is attached to the upper surface of the rising portion 322*b*. The holding member 360*b* can hold the air introduction pipe 330*b* in a state that the other end of the air introduction pipe 330*b* (end portion near the introduction port 331*b*) deformed into an inverted U-shape faces downward.

The height of the introduction port 331*b* held by the holding member 360*b* can be adjusted. More specifically, while the air introduction pipe 330*b* can be held so that the introduction port 331*b* is at a relatively high position as shown in FIG. 14A, the air introduction pipe 330*b* can also be held so that the introduction port 331*b* is at a relatively low position as shown in FIG. 14B. The height of the introduction port 331*b* can be changed to change the timing of transition from the first step to the second step.

The reason that the timing adjustment is possible will be described. The flow rate of the water supplied to a rim portion 120*b* by the jet pump unit 300*b* may not be strictly as in the design value due to, for example, the machine difference in a constant flow valve 232*b* arranged on the upstream side of a nozzle 310*b*, and the flow rate may vary between products. As a result, the washing performance of the bowl portion 110*b* may be insufficient, or a sufficient water flow may not be formed in the bowl portion 110*b* depending on the product.

For example, when the flow rate Q1 shown in FIG. 8 becomes high due to the machine difference in the constant flow valve 232*b*, water at the first flow rate is continuously supplied to the bowl portion 110*b* after a sufficient water flow is formed in the bowl portion 110*b* if the first step is continued up to the time t100.

Therefore, when the flow rate or the like of the water supplied to the rim portion 120*b* is not as in the design value, the height of the introduction port 331*b* is changed to adjust the timing of transition from the first step to the second step. Specifically, the height of the introduction port 331*b* is adjusted for each product when the first step is switched to the second step so that the height of the introduction port 331*b* is at the water level in the tank 20*b*. As a result of the adjustment, each product can be adjusted and optimized so that both of the ensuring of the washing performance of the bowl portion 110*b* and the ensuring of the formation of a sufficient water flow in the bowl portion 110*b* can be attained with good balance.

When the timing of ending the second step, i.e. the timing of ending the supply of water to the rim portion 120*b* by the jet pump action (time t200 in FIG. 8), is fixed, the length of the period from the start of the first step (time t0) to the end of the second step (time t200) is always constant. Therefore, the amount of water supplied to the rim portion 120*b* in the period is changed by the height (amount of adjustment) of the introduction port 331*b*.

For example, when the timing of the transition from the first step to the second step is adjusted to be earlier (when the first step is switched to the second step at a timing earlier than the time t100 of FIG. 8), the period of the first step with a high flow rate becomes shorter, and the period of the second step with a low flow rate becomes longer. As a result, the amount of water supplied to the rim portion 120*b* is smaller than before the adjustment, and the washing performance of the bowl portion 110*b* may be reduced.

On the other hand, when the timing of the transition from the first step to the second step is adjusted to be later (when the first step is switched to the second step at a timing later than the time t100 of FIG. 8), the period of the first step with a high flow rate becomes longer, and the period of the second step with a low flow rate becomes shorter. As a result, the amount of water supplied to the rim portion 120*b* is greater than before the adjustment, and the water level in the tank 20*b* may be reduced to the suction port 321*b* before washing of the bowl portion 110*b* is completed. In such a case, the water injected from the nozzle 310*b* reaches the rim portion 120*b* without being amplified by the jet pump action, and the water is consumed as wasteful water that does not contribute to the washing.

Therefore, the timing of ending the second step is changed based on the height (amount of adjustment) of the introduction port 331*b* in the flush toilet apparatus FTb.

Figure 15:
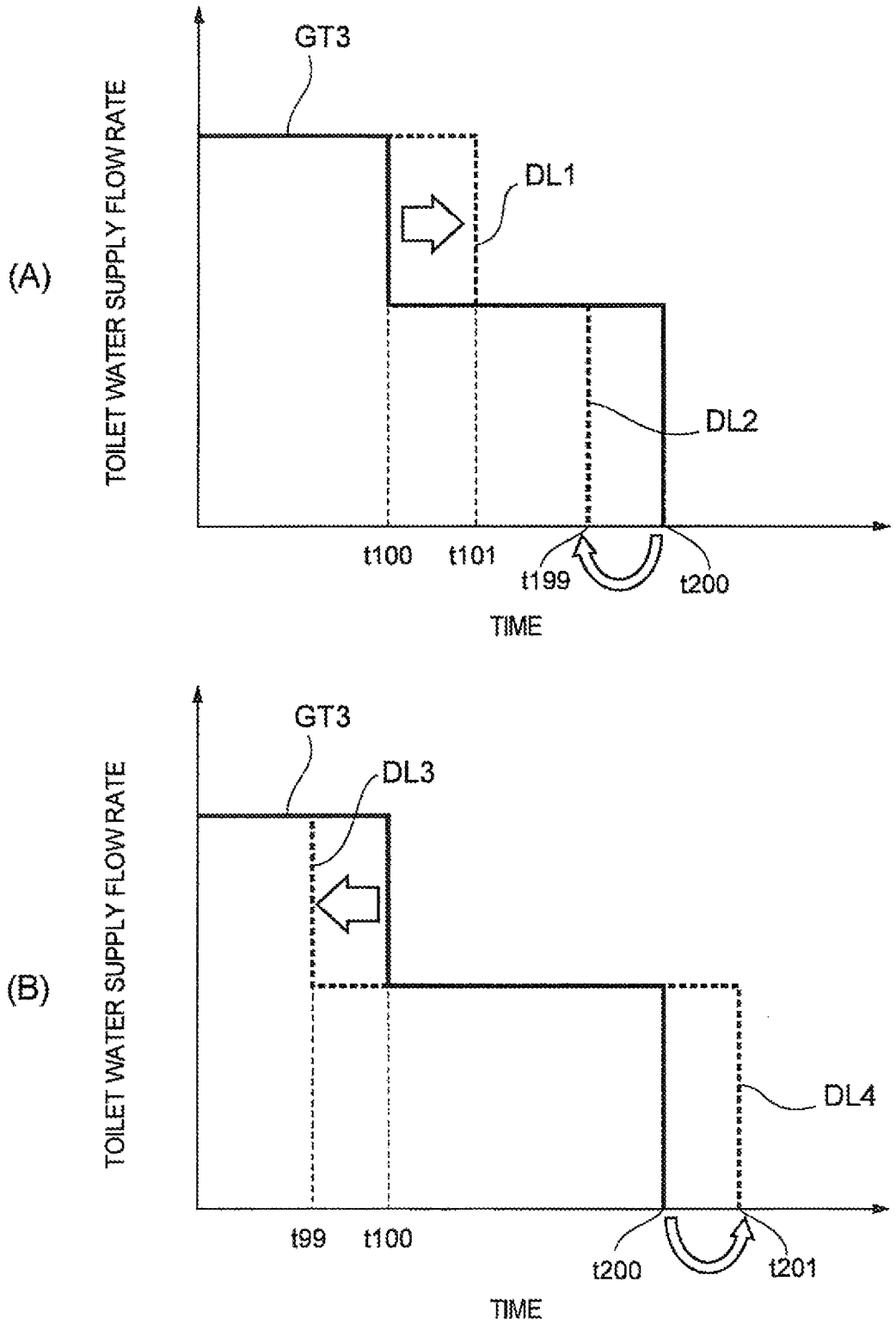
FIGS. 15A and 15B are graphs showing a change in the flow rate of the water supplied from the jet pump unit shown in FIGS. 14A and 14B to a rim portion.

The timing of ending the second step will be described with reference to FIGS. 15A and 15B. FIGS. 15A and 15B are graphs indicating changes in the flow rate of the water supplied from the jet pump unit 300*b* to the rim portion 120*b*. Graphs GT3 indicated by solid lines in FIGS. 15A and 15B show temporal changes in the flow rate when the flow rate of the water supplied to the rim portion 120*b* is changed at the same timing as in FIG. 8. More specifically, the graphs GT3 indicate the flow rate when the first step is switched to the second step at the time t100, and the second step ends at the time t200 as shown in FIG. 8.

When the height of the introduction port 331*b* is adjusted to be lower, the timing of transition from the first step to the second step becomes later as indicated by a dotted line DL1 of FIG. 15A (the first step is switched to the second step at time t101 later than the time t100). Therefore, the amount of water supplied to the rim portion 120*b* in the first step increases.

As already described in relation to the flush toilet apparatus FT, the second step ends when the water level in the tank 20*b* reaches the second water level in the present embodiment. Therefore, when the period of the first step (with high flow rate) becomes longer after the adjustment as described above, the timing that the water level in the tank 20*b* reaches the second water level becomes earlier. More specifically, as indicated by a dotted line DL2 of FIG. 15A, the timing of ending the second step becomes earlier (second step ends at time t199 earlier than the time t200).

In this way, while the period of the first step becomes longer, the period of the second step becomes shorter. As a result, the amount of water supplied to the rim portion 120*b* in the period from the start of the first step to the end of the second step is substantially equal to the amount before the adjustment of the height of the introduction port 331*b*.

When the height of the introduction port 331*b* is adjusted to be higher, the timing of transition from the first step to the second step becomes earlier as indicated by a dotted line DL3 of FIG. 15B (the first step is switched to the second step at time t99 earlier than the time t100). Therefore, the amount of water supplied to the rim portion 120*b* in the first step decreases.

The second step ends when the water level in the tank 20*b* reaches the second water level in the present embodiment. Therefore, when the period of the first step (with high flow rate) becomes shorter after the adjustment, the timing that the water level in the tank 20*b* reaches the second water level becomes later. More specifically, the timing of ending the second step becomes later as indicated by a dotted line DL4 of FIG. 15B (second step ends at time t201 later than the time t200).

In this way, while the period of the first step becomes shorter, the period of the second step becomes longer. As a result, the amount of water supplied to the rim portion 120*b* in the period from the start of the first step to the end of the second step is also substantially equal to the amount before the adjustment of the height of the introduction port 331*b*.

In this way, when the height of the introduction port 331*b* is adjusted, the time of ending the second step (length of the period of the second step) is automatically changed based on the amount of adjustment. According to the configuration, the reduction in the washing performance and the generation of the wasteful water can be prevented.

Subsequently, a flush toilet apparatus FTc according to a fourth embodiment of the present invention will be described. Although the flush toilet apparatus FTc is different from the flush toilet apparatus FT in that an air introduction pipe 330*c* includes an opening adjustment mechanism, other configurations are the same as those of the flush toilet apparatus FT. Therefore, the same configurations as those of the flush toilet apparatus FT will not be described.

Figure 16:
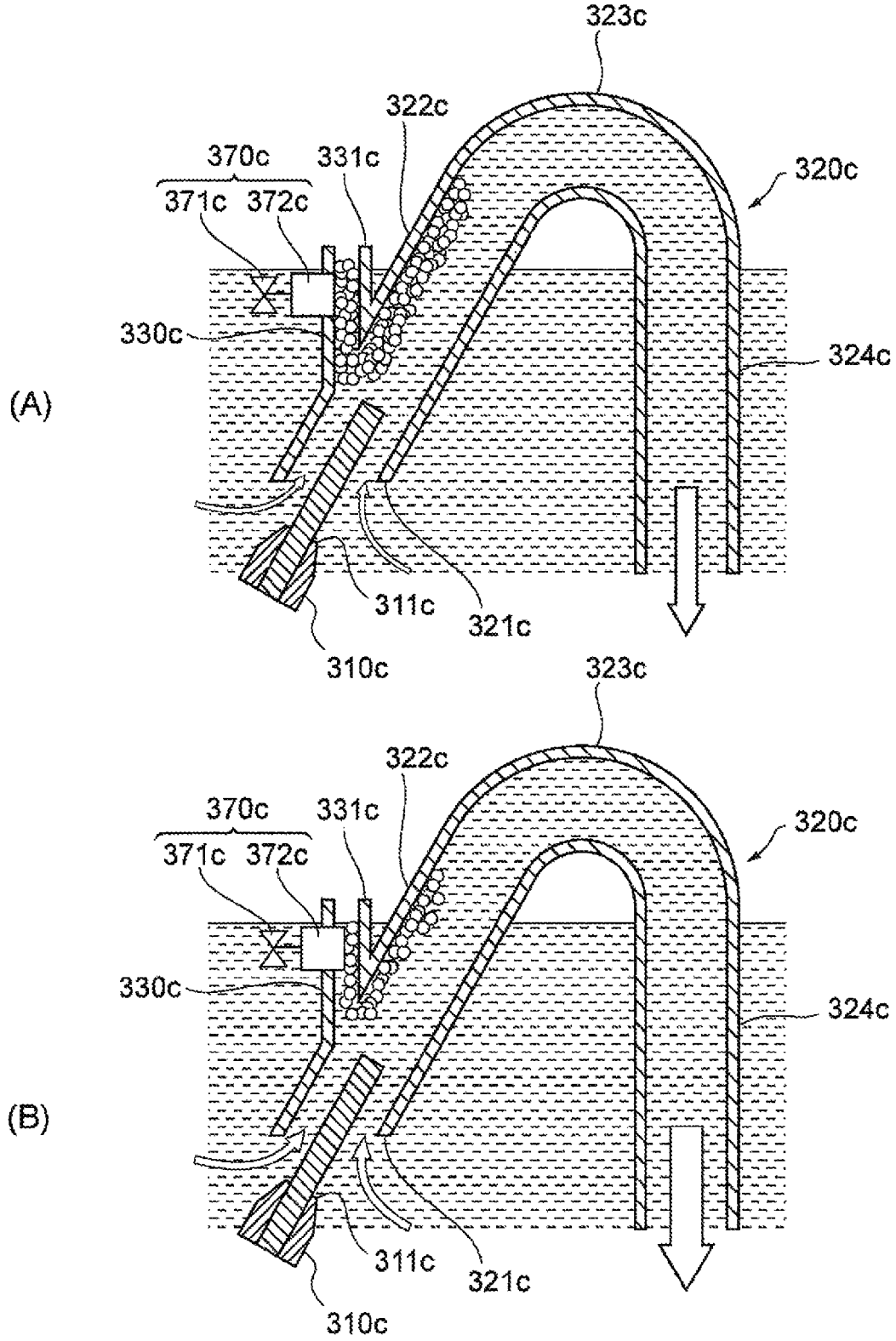
FIGS. 16A and 16B are diagrams for explaining a configuration of a jet pump unit of a flush toilet apparatus according to a fourth embodiment of the present invention.

FIGS. 16A and 16B are diagrams for explaining a configuration of a jet pump unit 300*c* of the flush toilet apparatus FTc. As shown in FIG. 16A, the air introduction pipe 330*c* is connected to a position substantially at the center of a rising portion 322*c* in the channel direction. The air introduction pipe 330*c* is a cylindrical pipe arranged in the vertical direction. The air introduction pipe 330*c* has substantially the same shape as the air introduction pipe 330 of the flush toilet apparatus FT and is arranged at the same position.

An introduction port 331*c* is opened and formed on the upper end of the air introduction pipe 330*c*, and air or water entered from the introduction port 331*c* can pass through the air introduction pipe 330*c* to enter the internal space of the rising portion 322*c*. The position (height) of the introduction port 331*c* is submerged when the water level of a tank 20*c* is the full water level. The position is higher than a suction port 321*c*.

An opening adjustment mechanism 370*c* is attached to the air introduction pipe 330*c*. The opening adjustment mechanism 370*c* includes a grip 371*c* arranged outside of the air introduction pipe 330*c* and a valve body 372*c* partially arranged inside of the air introduction pipe 330*c*. When the operator grabs and rotates the grip 371*c*, the position of the valve body 372*c* changes, and the channel cross-sectional area in the air introduction pipe 330*c* changes at the part.

As shown in FIG. 16A, when the channel cross-sectional area in the air introduction pipe 330*c* is adjusted to be larger, the amount of air entering the introduction port 331*c* in the second step, i.e. the amount of air mixed with the water flow inside of the throat pipe 320*c*, increases. As a result, the amount of suppression of the jet pump action increases, and the flow rate of the water supplied to a rim portion 120*c* in the second step decreases.

On the other hand, when the channel cross-sectional area in the air introduction pipe 330*c* is adjusted to be smaller, the amount of air entering the introduction port 331*c* in the second step, i.e. the amount of air mixed with the water flow inside of the throat pipe 320*c*, decreases as shown in FIG. 16B. As a result, the amount of suppression of the jet pump action decreases, and the flow rate of the water supplied to the rim portion 120*c* in the second step increases.

As already described, the flow rate of the water supplied to the rim portion 120*c* or the like may vary between products due to the machine difference in a constant flow valve 232*c*, variations in the shape of a toilet body 10*c*, or the like.

Therefore, when the flow rate of the water supplied to the rim portion 120*c* or the like is not as in the design value, the channel cross-sectional area in the air introduction pipe 330*c* is changed to adjust the amount of suppression of the jet pump action. Specifically, the opening adjustment mechanism 370*c* is operated to adjust the channel cross-sectional area in the air introduction pipe 330*c* so that the flow rate of the water supplied to the rim portion 120*c* in the second step becomes a flow rate that does not cause the wash water to be continuously and wastefully supplied to the bowl portion 110*c* when a sufficient water flow is formed in the bowl portion 110*c* before the end of the second step.

As a result of the adjustment, the largest possible amount of water can be supplied to the rim portion 120*c* within a range that the wash water is not wastefully supplied to the bowl portion 110*c*. In other words, each product can be adjusted and optimized so that both of the ensuring of the washing performance of the bowl portion 110*c* and the ensuring of the formation of a water flow in the bowl portion 110*c* can be attained with good balance.

When the channel cross-sectional area in the air introduction pipe 330*c* is adjusted to be larger to increase the amount of suppression of the jet pump action in the second step (to reduce the flow rate), the amount of water supplied to the rim portion 120*c* becomes smaller than before the adjustment. This prevents continuous and wasteful supply of wash water when a sufficient water flow is formed in the bowl portion 110*c*. On the other hand, the washing performance of the bowl portion 110*c* may be reduced.

On the other hand, when the channel cross-sectional area in the air introduction pipe 330*c* is adjusted to be smaller to reduce the amount of suppression of the jet pump action in the second step (to increase the flow rate), the amount of water supplied to the rim portion 120*c* becomes larger than before. As a result, the wash water may be continuously and wastefully supplied in the second step.

Therefore, the timing of ending the second step is changed based on the channel cross-sectional area (amount of adjustment by the opening adjustment mechanism 370*c*) in the air introduction pipe 330*c* in the flush toilet apparatus FTc.

Figure 17:
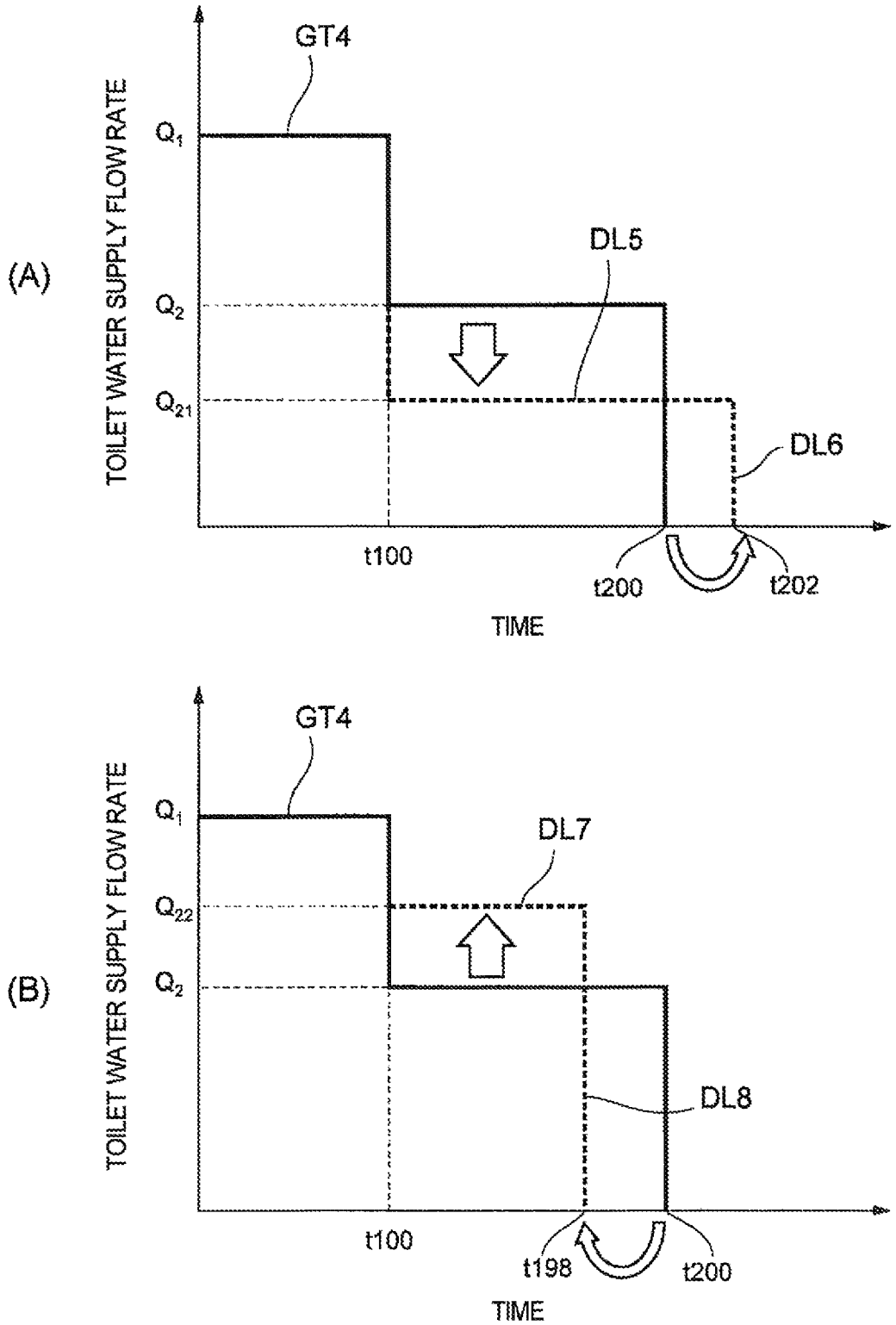
FIGS. 17A and 17B are graphs showing a change in the flow rate of the water supplied from the jet pump unit shown in FIGS. 16A and 16B to a rim portion.

The timing of ending the second step will be described with reference to FIGS. 17A and 17B. FIGS. 17A and 17B are graphs showing changes in the flow rate of the water supplied from the jet pump unit 300*c* to the rim portion 120*c*. Graphs GT4 indicated by solid lines in FIGS. 17A and 17B denote temporal changes in the flow rate when the flow rate of the water supplied to the rim portion 120*c* is the same as in FIG. 8. More specifically, the graphs GT4 indicate the temporal changes in the flow rate when water at the flow rate Q1 is supplied to the rim portion 120*c* in the first step up to the time t100, and water at the flow rate Q2 is supplied to the rim portion 120*c* in the second step up to the time t200 as shown in FIG. 8.

When the channel cross-sectional area in the air introduction pipe 330*c* is adjusted to be larger, the flow rate in the second step becomes lower as indicated by a dotted line DL5 of FIG. 17A (flow rate Q2 is changed to flow rate Q21).

As already described in relation to the flush toilet apparatus FT, the second step ends when the water level in the tank 20*c* reaches the second water level in the present embodiment. Therefore, when the flow rate in the second step becomes lower after the adjustment, the timing that the water level in the tank 20*c* reaches the second water level becomes later. More specifically, the timing of ending the second step becomes later (second step ends at time t202 later than the time t200) as indicated by a dotted line DL6 of FIG. 17A.

In this way, while the flow rate in the second step becomes lower, the period of the second step becomes longer. As a result, the amount of water supplied to the rim portion 120*c* in the period from the start of the first step to the end of the second step is substantially equal to the amount before the adjustment of the channel cross-sectional area in the air introduction pipe 330*c*.

When the channel cross-sectional area in the air introduction pipe 330*c* is adjusted to be larger, the flow rate in the second step becomes higher (flow rate Q2 changes to flow rate Q22) as indicated by a dotted line DL7 of FIG. 17B.

In the present embodiment, the second step ends when the water level in the tank 20*c* reaches the second water level. Therefore, when the flow rate in the second step becomes higher after the adjustment as described above, the timing that the water level in the tank 20*c* reaches the second water level becomes earlier. More specifically, the timing of ending the second step becomes earlier (second step ends at time t198 earlier than the time t200) as indicated by a dotted line DL8 of FIG. 17B.

In this way, while the flow rate in the second step becomes higher, the period in the second step becomes shorter. As a result, the amount of water supplied to the rim portion 120*c* in the period from the start of the first step to the end of the second step is substantially equal to the amount before the adjustment of the channel cross-sectional area in the air introduction pipe 330*c*.

As described, when the channel cross-sectional area in the air introduction pipe 330*c* is adjusted, the time of ending the second step (length of the period of the second step) is automatically changed based on the amount of adjustment. According to the configuration, the reduction in the washing performance and the generation of the wasteful water can be prevented.

Subsequently, a flush toilet apparatus FTd according to a fifth embodiment of the present invention will be described. In the flush toilet apparatus FTd, a tank 20*d* is arranged at a position higher than the position of the tank 20 shown in FIG. 1. Therefore, when water is supplied from the tank 20*d* to a rim portion 120*d*, the siphon action is generated inside of a throat pipe 320*d* in an inverted U-shape. More specifically, the water head (potential energy) of the water stored in the tank 20*d* generates a water flow, and the water flow is added to the already described water flow caused by the jet pump action. Although the flush toilet apparatus FTd is different from the flush toilet apparatus FT in this regard, other configurations are the same as those of the flush toilet apparatus FT. Therefore, the same configurations as those of the flush toilet apparatus FT will not be described.

Figure 18:
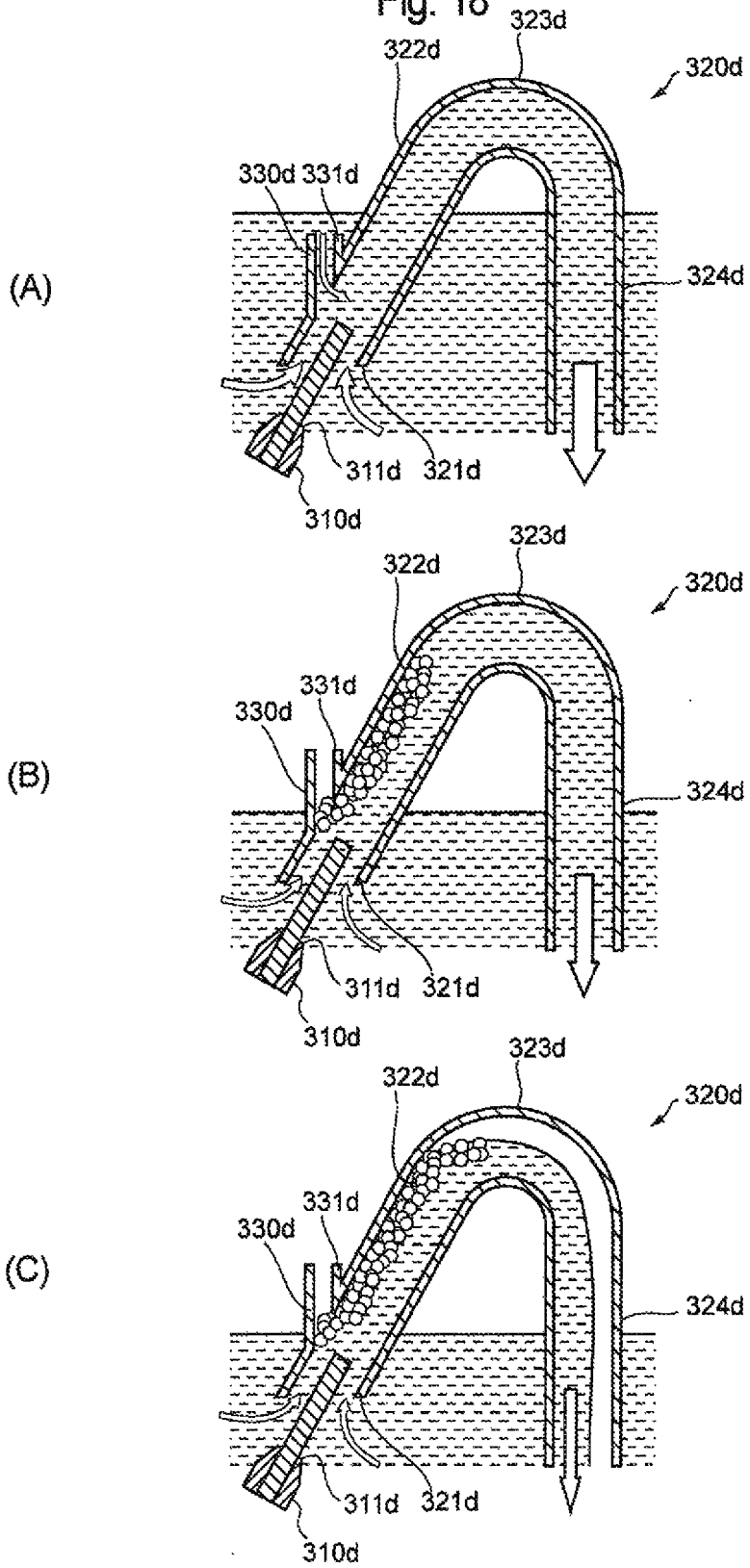
FIGS. 18A, 18B, and 18C are diagrams for explaining a configuration and operation of a jet pump unit of a flush toilet apparatus according to a fifth embodiment of the present invention.
Figure 19:
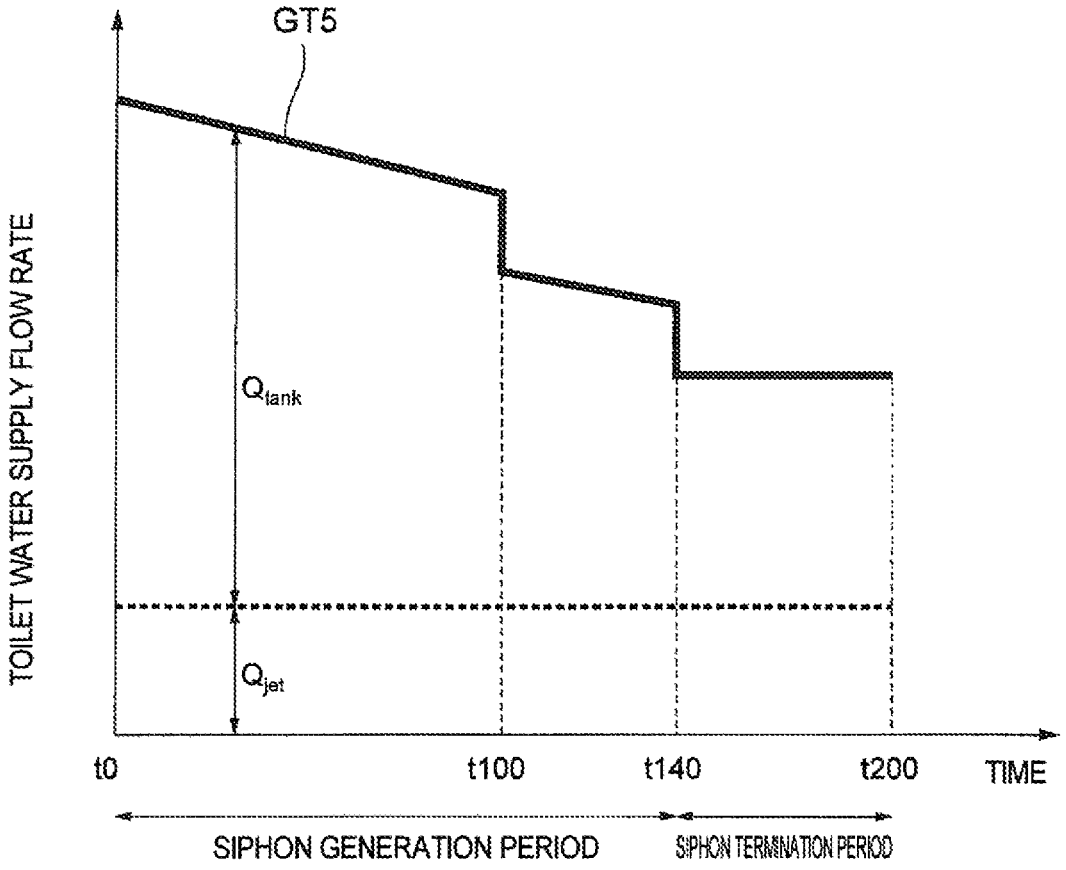
FIG. 19 is a graph showing a change in the flow rate of the water from the jet pump unit shown in FIGS. 18A, 18B, and 18C to a toilet body.

FIGS. 18A, 18B, and 18C are diagrams for explaining a structure and operation of a jet pump unit 300*d*, schematically showing a switch in the channel state of the jet pump unit 300*d*. FIG. 19 is a graph indicating a change in the flow rate of the water supplied to the rim portion 120*d*.

FIG. 18A schematically shows the channel state of the jet pump unit 300*d* just after the supply of water to the rim portion 120*d* is started. Although the water level in the tank 20*d* is started to be reduced from the full water level, the water level is higher than an introduction port 331*d* of an air introduction pipe 330*d*. Therefore, the introduction port 331*d* is submerged.

In a rising portion 322*d*, water entered from a suction port 321*d* flows toward a curved portion 323*d*. The water flow generates negative pressure in the water inside of the air introduction pipe 330*d*, and the water is drawn into the rising portion 322*d*. As a result, not only the water entered from the suction port 321*d*, but also the water entered from the introduction port 331*d* flows inside of the rising portion 322*d*. In addition, a water flow caused by the siphon action is also generated inside of the throat pipe 320*d*. Therefore, a large amount of water caused by the jet pump action and the siphon action is supplied to the rim portion 120*d* as wash water.

A large amount of water is supplied to the rim portion 120*d* as described above in the period from the start of the injection of water from the nozzle 310*d* (time t0) to the time that the water level in the tank 20*d* is at the position of the introduction port 331*d* (first water level) after the decrease in the water level (time t100). However, the water level in the tank 20*d* gradually decreases, and the water flow caused by the jet pump action also gradually becomes smaller accordingly. As a result, the flow rate of the water supplied to the rim portion 120*d* gradually becomes lower in the first step up to the time t100 as shown in FIG. 19.

As in the flush toilet apparatus FT, when the water level in the tank 20*d* decreases to the first water level (position of the introduction port 331*d*), the first step ends, and the first step is switched to the second step. In this case, although the negative pressure is still generated by the water flow inside of the rising portion 322*d* (near the lower end portion of the air introduction pipe 330*d*), the introduction port 331*d* appears above the water surface (not submerged). Therefore, air, not water, enters from the introduction port 331*d*.

FIG. 18B schematically shows a channel state of the jet pump unit 300*d* in this case. The water is continuously injected from the nozzle 310*d*, and the water flow is generated by the jet pump action inside of the throat pipe 320*d*. However, the air from the air introduction pipe 330*d* is mixed with the water flow. The air mixed inside of the throat pipe 320*d* suppresses the jet pump action, and the flow rate of the water flowing inside of the throat pipe 320*d* decreases. As shown in FIG. 19, the flow rate of the water supplied to the rim portion 120*d* rapidly decreases when the first step is switched to the second step (time t100).

After the entrance of the air from the introduction port 331*d* and the transition to the second step, the siphon action is continuously generated without stopping. Along with the gradual reduction of the water level in the tank 20*d*, the flow rate of the water supplied to the rim portion 120*d* gradually decreases even after the time t100.

The air entered inside of the throat pipe 320*d* from the introduction port 331*d* rises toward the curved portion 323*d* and is accumulated inside of the curved portion 323*d* (near the top). At time t140 after a short time from the time t100, the water (water mass) that has been filling up the inside of the throat pipe 320*d* is divided by the air in the curved portion 323*d*. As a result, the siphon action stops in the middle of the second step (time t140). In this way, the air introduction pipe 330*d* according to the present embodiment functions to suppress the jet pump action in the second step and functions to stop the siphon action at the time t140. The air introduction pipe 330*d* has these two functions, and as a result, the structure inside of the tank 20*d* is simplified.

FIG. 18C schematically shows a channel state of the jet pump unit 300*d* in this case. The water is continuously injected from the nozzle 310*d*, and only the water flow caused by the jet pump action is generated inside of the throat pipe 320*d*. The stop of the siphon action in addition to the mixing of the air from the air introduction pipe 330*d* further reduce the flow rate of the water flowing inside of the throat pipe 320*d*. As shown in FIG. 19, the flow rate of the water supplied to the rim portion 120*d* rapidly decreases again at the time t140 with the stop of the siphon action.

Subsequently, the water is supplied to the rim portion 120*d* until the water level in the tank 20*d* is further reduced to the second water level. When the water level in the tank 20*d* is reduced to the second water level, the second step ends, and the storage of the water in the tank 20*d* is started by the operation of a channel switching member 350*d*.

As is clear from the above description and FIG. 19, the jet pump action is suppressed at the point (time t100) of the switch from the first step to the second step in the present embodiment, and the flow rate of the water supplied to the rim portion 120*d* rapidly decreases. In the present embodiment, the siphon action stops in the middle (time t140) of the period of the second step, and the flow rate of the water supplied to the rim portion 120*d* rapidly decreases again.

In the first step, both of the jet pup action and the siphon action are generated, and a large amount of water is supplied to the rim portion 120*d*. As a result, a water flow necessary to discharge the waste can be surely formed in the bowl portion 110. The siphon action that has been generated stops at the time t140 which is after the transition to the second step. Therefore, the flow rate of the water (large amount) supplied to the rim portion 120*d* can be easily reduced in the second step.

The throat pipe 320*d* has an inverted U-shape. Therefore, even if the air is mixed in a falling portion 324*d*, the air may rise toward the curved portion 323*d* and may be accumulated at the top of the curved portion 323*d*.

However, a strong downward water flow is generated in the falling portion 324*d* when the siphon action is generated in the throat pipe 320*d*. Therefore, when the air is mixed in the falling portion 324*d*, the air may be washed out downward by the water flow (with force stronger than buoyance) and may not be accumulated at the top of the curved portion 323*d*. As a result, the siphon action may not be stopped even if the air is mixed.

Therefore, the air introduced from the introduction port 331*d* is mixed with the water flow on the upstream side of the falling portion 324*d* in the present embodiment. The introduced air is accumulated at the top of the curved portion 323*d* without being washed out downward, and the air can surely stop the siphon action.

Figure 20:
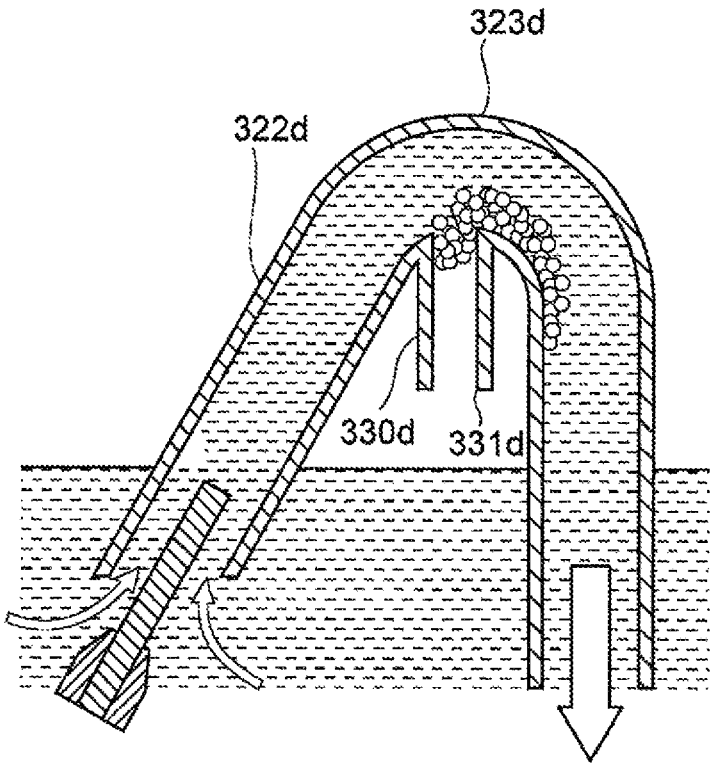
FIG. 20 is a diagram for explaining a case in which an air introduction pipe is arranged in a curved portion.

The transition to the second step due to the introduction of air from the introduction port 331*d* and the stop of the siphon action may be performed at the same time. For example, when the air introduction pipe 330*d* is arranged on the lower surface of the curved portion 323*d* as shown in FIG. 20, the air introduced from the introduction port 331*d* is immediately accumulated at the top of the curved portion 323*d*, and the siphon action is stopped. Therefore, the siphon action stops substantially at the same time as the transition to the second step.

On the other hand, the timing of the transition to the second step after the introduction of the air from the introduction port 331*d* (time t100) and the timing of stopping the siphon action (time t140) are different in the present embodiment. The timing of stopping the siphon action is delayed by the time of the movement of the air mixed with the water flow in the rising portion 322*d* to the curved portion 323*d*.

According to the configuration, the flow rate of the water supplied to the rim portion 120*d* in the second step decreases in stages with time as shown in FIG. 19. In this way, the largest possible amount of water is supplied to the rim portion 120*d* while saving water.

Subsequently, a flush toilet apparatus FTe according to a sixth embodiment of the present invention will be described. The flush toilet apparatus FTe is different from the flush toilet apparatus FT in that the air introduction pipe 330 is not connected to a throat pipe 320*e* and that a movable member 380*e* is attached to the throat pipe 320*e*. Other configurations are the same as those of the flush toilet apparatus FT. Therefore, the same configurations as those of the flush toilet apparatus FT will not be described.

Figure 21:
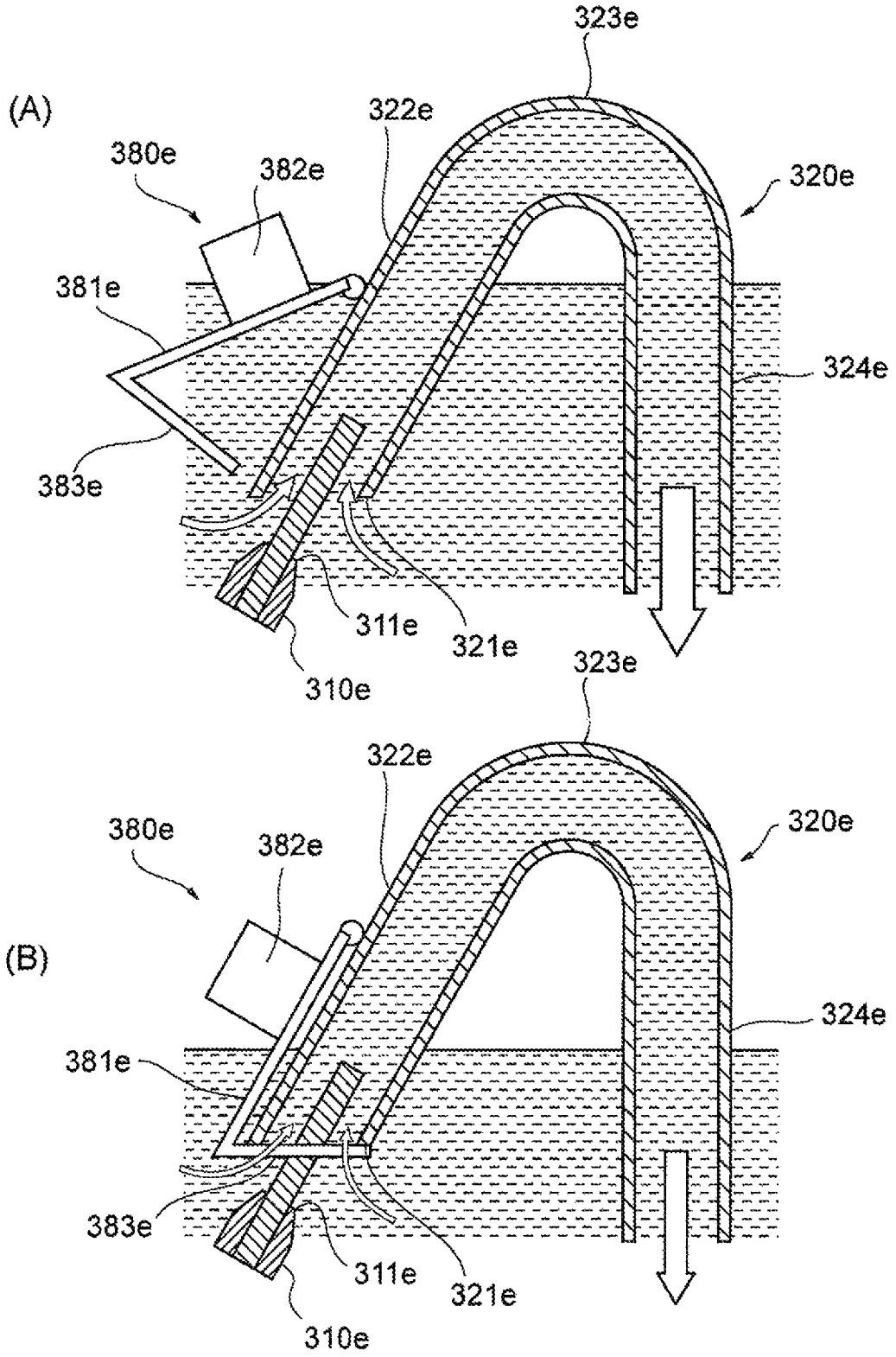
FIGS. 21A and 21B are diagrams for explaining a configuration and operation of a jet pump unit of a flush toilet apparatus according to a sixth embodiment of the present invention.

FIGS. 21A and 21B are diagrams for explaining a structure and operation of a jet pump unit 300*e*, schematically showing a switch in the channel state of the jet pump unit 300*e*. As shown in FIG. 21A, the movable member 380*e* is attached to a rising portion 322*e* of the throat pipe 320*e*. The moveable member 380*e* includes a supporting portion 381*e*, a float 382*e*, and a suppression plate 383*e*.

The supporting portion 381*e* is a plate attached to the rising portion 322*e*, and the supporting portion 381*e* can be freely turned. The upper end of the supporting portion 381*e* is attached to the upper surface of the rising portion 322*e*, and the supporting portion 381*e* can be turned about the upper end.

The float 382*e* receives the buoyance from the water stored in the tank 20*e* and operates the movable member 380*e* by the buoyance. The float 382*e* is fixed to the supporting portion 381*e* and turns along with the supporting portion 381*e*. The lower end of the float 382*e* is positioned higher than a suction port 321*e* even when the float 382*e* is moved to the lowest position in the movable range.

The suppression plate 383*e* is a plate extending from the lower end of the supporting portion 381*e* toward the throat pipe 320*e*. The supporting portion 381*e* turns along with the supporting portion 381*e* by the buoyance received by the float 382*e*.

FIG. 21A schematically shows a channel state of the jet pump unit 300*e* just after the supply of water to a rim portion 120*e* is started. In this case, since the water level in the tank 20*e* is high, the movable member 380*e* is turned by the buoyance received by the float 382*e*, and the suppression plate 383*e* is out of the suction port 321*e* (not covering the suction port 321*e*). The water stored in the tank 20*e* enters inside of the throat pipe 320*e* without being inhibited by the suppression plate 383*e*, and a large amount of water is supplied to the rim portion 120*e* by the jet pump action.

The water level in the tank 20*e* gradually decreases, and the position of the float 382*e* also gradually lowers accordingly. FIG. 21B shows a state in which the float 382*e* has moved to the lowest end of the movable range, and the suppression plate 383*e* covers the suction port 321*e*. In this case, the suppression plate 383*e* is parallel to the edge of the suction port 321*e* and is arranged slightly below the suction port 321*e*. The water level in the tank 20*e* is still higher than the suction port 321*e* at this point and the water is continuously supplied to the rim portion 120*e*.

Figure 22:
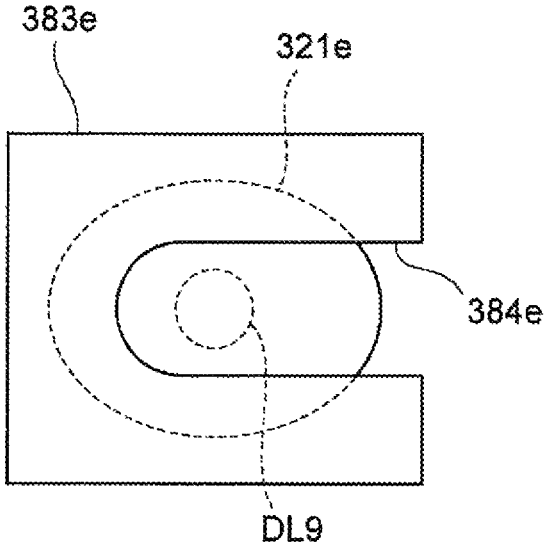
FIG. 22 is a diagram for explaining a shape of a movable member in the jet pump unit shown in FIGS. 21A and 21B.

FIG. 22 is a diagram showing the suppression plate 383*e* in FIG. 21B viewed from below. As shown in FIG. 22, the suppression plate 383*e* is a rectangular plate covering substantially the entire suction port 321*e*. The suppression plate 383*e* is provided with a notch 384*e* from one side of the suppression plate 383*e* (side opposite the side connected with the supporting portion 381*e*) to the center.

A circle indicated by a dotted line DL9 in FIG. 22 virtually illustrates a cross section of the water flow injected from the nozzle 310*e*. In other words, the circle is obtained by projecting the shape of an injection port 311*e* on a plane including the surface of the suppression plate 383*e*, in the injection direction of the water. The circle is included inside of the notch 384*e*.

In the state that the suppression plate 383*e* in this shape covers the suction port 321*e*, the water injected from the nozzle 310*e* passes inside of the notch 384*e*. Therefore, the water flows inside of the rising portion 322*e* without being inhibited by the suppression plate 383*e*. On the other hand, the flow of the water drawn in by the jet pump action (water stored in the tank 20*e*) is partially inhibited by the suppression plate 383*e*. As a result, the jet pump action is suppressed, and the flow rate of the water supplied to the rim portion 120*e* decreases.

In this way, the movable member 380*e* is operated when the water level in the tank 20*e* decreases in the present embodiment. As a result, the channel state of the jet pump unit 300*e* is switched to the state in which the jet pump action is suppressed (second step). The position of the suppression plate 383*e* is not limited to near the suction port 321*e*, and the transition to the state in which the jet pump action is suppressed (second step) is also possible even if the suppression plate 383*e* is inside of the throat pipe 320*e*.

Subsequently, a flush toilet apparatus FTg according to a seventh embodiment of the present invention will be described. Although a structure of a rising portion 322*g* of the flush toilet apparatus FTg is different from that of the flush toilet apparatus FT, other configurations are the same as those of the flush toilet apparatus FT. Therefore, the same configurations as those of the flush toilet apparatus FT will not be described.

Figure 23:
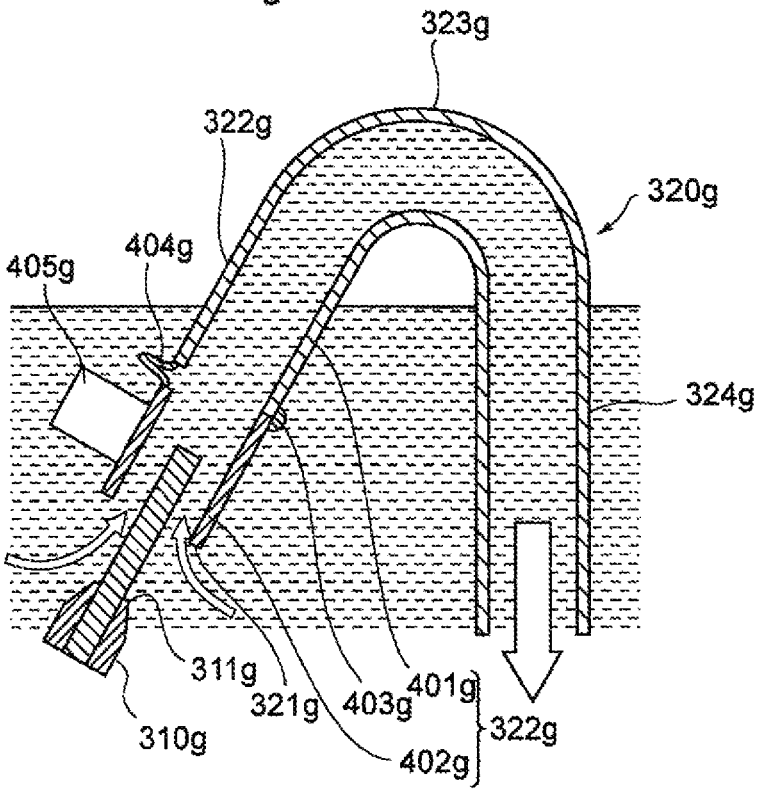
FIGS. 23A and 23B are diagrams for explaining a configuration and operation of a jet pump unit of a flush toilet apparatus according to a seventh embodiment of the present invention.
Figure 23:
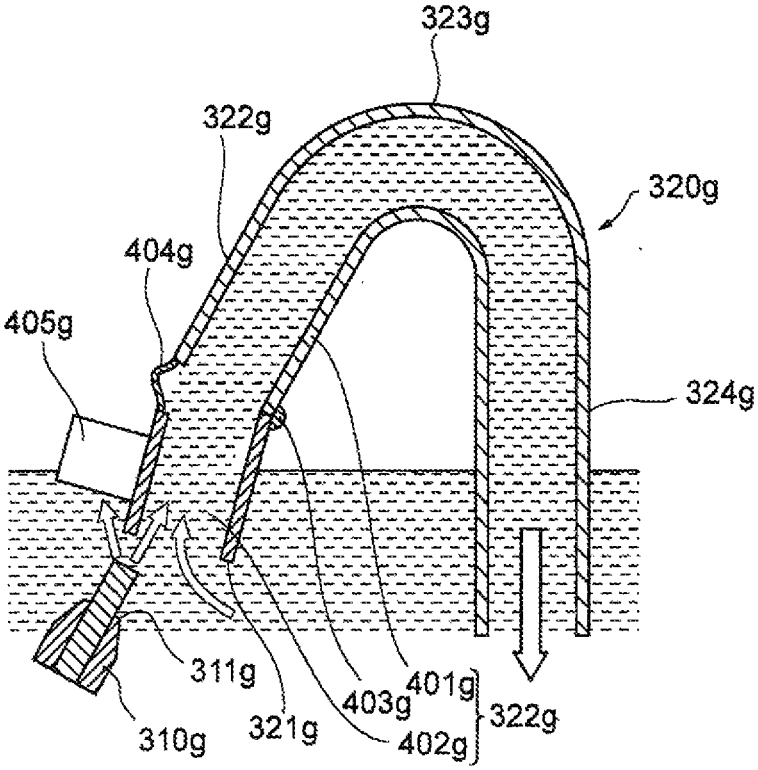

FIGS. 23A and 23B are diagrams for explaining a structure and operation of a jet pump unit 300*g*, schematically showing a switch in the channel state of the jet pump unit 300*g*. As shown in FIG. 23A, the rising portion 322*g* of a throat pipe 320*g* is divided into a first rising portion 401*g* and a second rising portion 402*g* that are connected to each other through a hinge 403*g*.

The first rising portion 401*g* is a part on the upper side (downstream) of the rising portion 322*g*, and the upper end of the first rising portion 401*g* is connected to a curved portion 323*g*. The second rising portion 402*g* is a part on the lower side (upstream) of the rising portion 322*g* and is connected to the lower end of the first rising portion 401*g* through the hinge 403*g*. The hinge 403*g* is arranged on the lower side of the rising portion 322*g* to support the second rising portion 402*g*, allowing the second rising portion 402*g* to freely turn According to the configuration, the position of a suction port 321*g* as a lower end of the second rising portion 402*g* can be changed.

A connection pipe 404*g* is arranged between the first rising portion 401*g* and the second rising portion 402*g*. The connection pipe 404*g* is a pipe formed by a flexible resin, and the connection pipe 404*g* prevents water from flowing out from between the first rising portion 401*g* and the second rising portion 402*g*. The connection pipe 404*g* can be easily deformed, and the operation of the second rising portion 402*g* is not inhibited.

A float 405*g* is fixed to the upper side of the second rising portion 402*g*. The float 405*g* receives the buoyance from the water stored in a tank 20*g* and operates the second rising portion 402*g* by the buoyance. The float 405*g* is arranged at a position where the entire float 405*g* is submerged when the water level in the tank 20*g* is the full water level. The float 405*g* is arranged at a position higher than the suction port 321*g*.

FIG. 23A schematically shows a channel state of the jet pump unit 300*g* just after the start of the supply of water to a rim portion 120*g*. In this case, the water level in the tank 20*g* is high, and the second rising portion 402*g* is turned by the buoyance received by the float 405*g*. The central axis of the first rising portion 401*g* coincides with the central axis of the second rising portion 402*g*. The jet pump action causes the water stored in the tank 20*g* to enter inside of the throat pipe 320*g* from the suction port 321*g*, and the water is supplied to the rim portion 120*g*.

The water level in the tank 20*g* gradually decreases, and the position of the float 405*g* also gradually lowers accordingly. In other words, the second rising portion 402*g* turns to move the suction port 321*g* downward and toward a falling portion 324*g*.

FIG. 23B shows a state when the float 405*g* moves to the lowest end of the movable range. In this case, since the suction port 321*g* has moved toward the falling portion 324*g*, only part of the water injected from a nozzle 310*g* enters inside of the throat pipe 320*g* from the suction port 321*g*, and the rest of the water is supplied inside of the tank 20*g*. The water level in the tank 20*g* is still higher than the suction port 321*g* at this point, and the water is continuously supplied to the rim portion 120*g*.

Since the flow rate of the water injected inside of the throat pipe 320*g* from the nozzle 310*g* decreases, the flow rate of the water (water stored in the tank 20*g*) drawn into the throat pipe 320*g* by the jet pump action also decreases. As a result, the jet pump action is suppressed, and the flow rate of the water supplied to the rim portion 120*g* also decreases.

In this way, the second rising portion 402*g* is operated in the present embodiment when the water level in the tank 20*g* decreases, and the channel state of the jet pump unit 300*g* is switched to the state of suppressing the jet pump action (second step).

Subsequently, a flush toilet apparatus FTh according to an eighth embodiment of the present invention will be described. Although a structure of a falling portion 324*h* of the flush toilet apparatus FTh is different from that of the flush toilet apparatus FT, other configurations are the same as those of the flush toilet apparatus FT. Therefore, the same configurations as those of the flush toilet apparatus FT will not be described.

Figure 24:
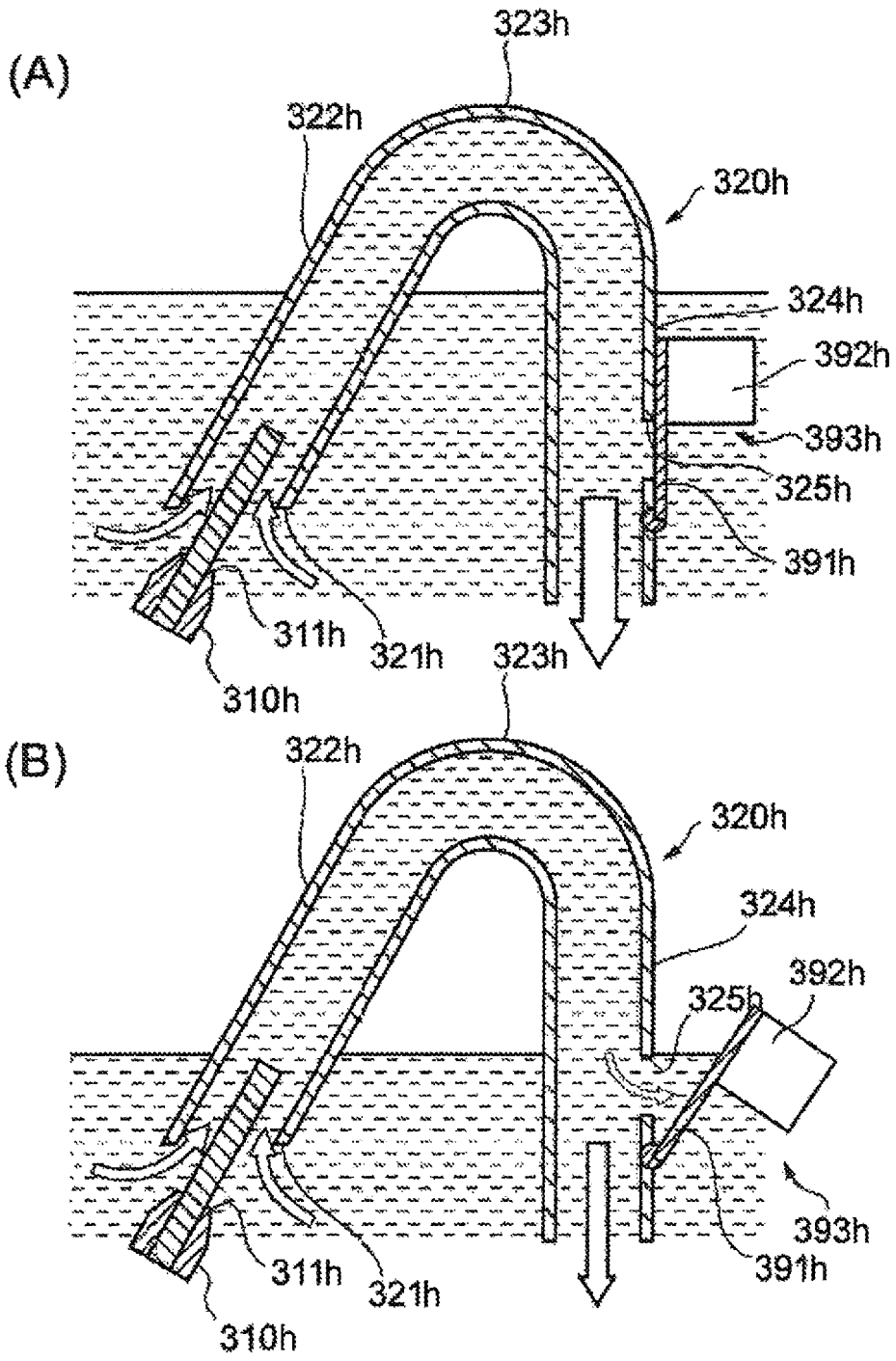
FIGS. 24A and 24B are diagrams for explaining a configuration and operation of a jet pump unit of a flush toilet apparatus according to an eighth embodiment of the present invention.

FIGS. 24A and 24B are diagrams for explaining a change in the flow rate of water supplied to a rim portion 120*h*, schematically showing a switch in the channel state of a jet pump unit 300*h*. As shown in FIG. 24A, a movable member 393*h* as channel state switching portion is attached to the falling portion 324*h* of a throat pipe 320*h*. The movable member 393*h* includes an open/close plate 391*h* and a float 392*h*. The open/close plate 391*h* is a plate attached to the falling portion 324*h*, and the open/close plate 391*h* can be freely rotated. The lower end of the open/close plate 391*h* is attached to the outer surface of the falling portion 324*h*, and the open/close plate 391*h* can rotate about the lower end.

The float 392*h* receives the buoyance of the water stored in a tank 20*h* and operates the movable member 393*h* by the buoyance. The float 392*h* is fixed near the upper end portion of the open/close plate 391*h*, and the float 392*h* rotates along with the open/close plate 391*h*.

An open portion 325*h* is formed at a position facing the open/close plate 391*h* in the falling portion 324*h* of the throat pipe 320*h*. The open portion 325*h* is formed at a position where the entire open portion 325*h* is submerged when the water level in the tank 20*h* is the full water level. The height of the lower end of the open portion 325*h* is higher than a suction port 321*h*.

When the user of the flush toilet apparatus FTh operates a manual lever 236*h* (step S01 of FIG. 6), water is injected from a nozzle 310*h*, and the water is supplied to the rim portion 120*h* by the jet pump action as already described (step S02 of FIG. 6).

As shown in FIG. 24A, the water level in the tank 20*h* is high at this point, and the open/close plate 391*h* of the movable member 393*h* is parallel to the outer surface of the falling portion 324*h* due to the buoyance received by the float 392*h*. As a result, the open/close plate 391*h* covers the open portion 325*h*, and the water cannot pass through the open portion 325*h*. Therefore, the jet pump action causes the water stored in the tank 20*h* to enter inside of the throat pipe 320*h* from the suction port 321*h*, and the entire water is supplied to the rim portion 120*h*.

As described, a large amount of water is supplied to the rim portion 120*h* in the period from the start of the injection of water from the nozzle 310*h* to the time that the water level in the tank is at the position of the lower end of the float 392*h* after the decrease in the water level (water level at this point will also be called "first water level"). The step of supplying a large amount of water from the jet pump unit 300*h* in the period will also be called "first step" (step S03 of FIG. 6).

When the water level in the tank 20*h* gradually decreases and reaches the first water level, the position of the float 392*h* also gradually lowers accordingly. In other words, the movable member 393*h* rotates in a direction that the upper end portion of the open/close plate 391*h* moves away from the falling portion 324*h*, and the first step ends (step S04 of FIG. 6).

FIG. 24B shows a state that the open portion 325*h* is opened (not covered by the open/close plate 391*h*) after the decrease in the water level in the tank 20*h* and the movement of the float 392*h* downward. The water level in the tank 20*h* is still higher than the suction port 321*h* at this point, and the water is continuously supplied to the rim portion 120*h*.

In this case, although the water stored in the tank 20*h* continuously enters inside of the throat pipe 320*h* from the suction port 321*h* due to the jet pump action, part of the water flows out from the throat pipe 320*h* through the open portion 325*h*. As a result, the flow rate of the water supplied to the rim portion 120*h* decreases. More specifically, the flow rate of the water supplied to the rim portion 120*h* is lower than the flow rate in the first step. In this way, the step of supplying water at the decreased flow rate to the rim portion 120*h* as wash water after the end of the first step will also be called "second step" (step S05 of FIG. 6). The second step continues until a channel switching member 350*h* is in the state shown in FIG. 4B after further decrease in the water level in the tank 20*h* (steps S06 and S07 of FIG. 6).

The water level in the tank 20*h* when the channel switching member 350*h* rotates and enters the state shown in FIG. 4B after the reduction in the buoyance applied to the float 351*h* of the channel switching member 350*h* will also be called "second water level". More specifically, the second water level is the water level in the tank 20*h* when the supply of wash water to the rim portion 120*h* is stopped.

When the second step is finished, water is continuously injected from the nozzle 310*h* as already described, and the water is stored in the tank 20*h* (step S08 of FIG. 6). When the water level in the tank 20*h* rises and reaches the full water level, the injection of water from the nozzle 310*h* is stopped, and the storage of water in the tank 20*h* is stopped (steps S09 and S10 of FIG. 6).

Water (refill water) for forming the sealing water WT may be added and supplied from the jet pump unit 300*h* to the rim portion 120*h* after the bowl portion 110*h* is washed. It is desirable that the supply of the refill water is started at a timing of one of the point that the second step is finished (just after step S07 of FIG. 6) and the point that the storage of water in the tank 20*h* is stopped (just after step S10 of FIG. 6). When the supply of the refill water is started at the point that the second step is finished, the storage of water in the tank 20*h* and the addition of refill water to the rim portion 120*h* are performed at the same time.

The embodiments of the present invention have been described with reference to the specific examples. However, the present invention is not limited to the specific examples. More specifically, appropriate design changes of the specific examples by those skilled in the art are also included in the scope of the present invention as long as the features of the present invention are included. For example, the elements as well as the arrangements, the materials, the conditions, the shapes, the sizes, etc., of the elements included in the specific examples are not limited to the illustrated ones, and appropriate changes can be made. The elements included in the embodiments can be combined if technically possible, and these combinations are also included in the scope of the present invention as long as the features of the present invention are included.

What is claimed is:

1. A flush toilet apparatus that washes a toilet body by wash water, the flush toilet apparatus comprising:

a wash-down toilet body comprising: a bowl portion that receives waste; and a water ejection portion that ejects water for discharging the waste to supply the water to the bowl portion, wherein the water supplied to the bowl portion pushes out the waste to a drainage channel;

a tank storing water inside; and a jet pump unit arranged in a state that at least part of the jet pump unit is submerged inside of the tank, wherein the jet pump unit comprises:

a throat pipe that is a pipe provided with a suction port near one end and that is arranged so that water entering inside from the suction port is supplied to the water ejection portion, and the water is ejected from the water ejection portion as wash water; and a nozzle that injects high-speed water from the suction port toward the inside of the throat pipe, the jet pump unit is configured to induce a jet pump action for making a flow rate of the water flowing inside of the throat pipe higher than a flow rate of the water injected from the nozzle and to supply the water at the increased flow rate to the water ejection portion, the flush toilet apparatus further comprises a channel state switching portion for switching a channel state of the jet pump unit to sequentially execute a water flow forming step, in which the jet pump unit supplies water at a first flow rate to the water ejection portion, and a water flow maintaining step, which is a step following the water flow forming step and in which the jet pump unit supplies water at a second flow rate lower than the first flow rate, and higher than the rate at which the nozzle injects the water, to the water ejection portion, the throat pipe comprises: a rising portion extending upward from the suction port; and a curved portion arranged on the downstream side of the rising portion, the channel state switching portion comprises an air introduction pipe provided with an introduction port for introducing air, and the air introduction pipe is connected to the rising portion of the throat pipe.

2. The flush toilet apparatus according to claim 1, wherein the higher the flow rate of the water supplied to the water ejection portion in the water flow forming step, the earlier the timing of transition from the water flow forming step to the water flow maintaining step.

3. The flush toilet apparatus according to claim 2, wherein the water flow forming step is switched to the water flow maintaining step when the water level in the tank decreases to a predetermined water level set at a position lower than a full water level and higher than the suction port.

4. The flush toilet apparatus according to claim 1, wherein the channel state switching portion switches the channel state on a downstream side of the nozzle in the jet pump unit.

5. The flush toilet apparatus according to claim 4, wherein the channel state switching portion switches the channel state on the downstream side of the suction port in the jet pump unit.

6. The flush toilet apparatus according to claim 5, wherein the throat pipe comprises a falling portion arranged on the downstream side of the curved portion and extending downward from the curved portion, wherein the entire throat pipe is formed in an inverted U-shape, and the channel state switching portion switches the channel state on an upstream side of the falling portion in the jet pump unit.

7. The flush toilet apparatus according to claim 1, wherein the channel state switching portion switches the channel state of the jet pump unit so that an air introduction flow rate from the introduction port in the water flow maintaining step is greater than an air introduction flow rate from the introduction port in the water flow forming step.

8. The flush toilet apparatus according to claim 7, wherein the introduction port is formed at a position submerged in the tank in a period that the water flow forming step is executed and not submerged in the tank in a period that the water flow maintaining step is executed.

9. The flush toilet apparatus according to claim 1, wherein the air introduced from the introduction port is mixed with the water flow generated by the jet pump action at a position on the downstream side of the suction port.

10. The flush toilet apparatus according to claim 1, wherein the throat pipe comprises: a rising portion extending upward from the suction port; a curved portion arranged on the downstream side of the rising portion; and a falling portion arranged on the downstream side of the curved portion and extending downward from the curved portion, wherein the entire throat pipe is formed in an inverted U-shape, and a siphon action is generated in addition to the jet pump action, water is supplied to the water ejection portion based on the jet pump action and the siphon action in the water flow forming step, and the siphon action is stopped after the transition to the water flow maintaining step.

11. The flush toilet apparatus according to claim 10, wherein the timing of transition from the water flow forming step to the water flow maintaining step and the timing of stopping the siphon action are different.

12. The flush toilet apparatus according to claim 11, wherein the channel state switching portion switches the channel state of the jet pump unit by mixing the air with the water flow generated by the jet pump action, and stops the siphon action by the air mixed with the water flow from the air introduction portion.

13. The flush toilet apparatus according to claim 1, wherein the introduction port of the air introduction pipe is positioned at an upper side of the connection part of the air introduction pipe and the rising portion.

* * * * *